US005214447A

United States Patent [19]

Iwata

[11] Patent Number: 5,214,447

[45] Date of Patent: May 25, 1993

[54] SUCTION RECOVERY DEVICE AND INK JET RECORDING APPARATUS WITH THE DEVICE

[75] Inventor: Kazuya Iwata, Kawasaki, Japan

[73] Assignee: Canon Kabushiki Kaisha, Tokyo, Japan

[21] Appl. No.: 634,766

[22] Filed: Dec. 27, 1990

[30] Foreign Application Priority Data

Dec. 29, 1989 [JP] Japan ..... 1-344914

[51] Int. Cl.[5] ..... B41J 2/165

[52] U.S. Cl. ..... 346/140 R

[58] Field of Search ..... 346/140 R; 400/701, 400/702, 126

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,383,263 | 5/1983 | Ozawa et al. | 346/140 R |
| 4,410,900 | 10/1983 | Terasawa | 346/140 R |
| 4,459,600 | 7/1984 | Sato et al. | 346/140 R |
| 4,463,359 | 7/1984 | Ayata et al. | 346/1.1 |
| 4,543,589 | 9/1985 | Terasawa | 346/140 R |
| 4,558,333 | 12/1985 | Sugitani et al. | 346/140 R |
| 4,600,931 | 7/1986 | Terasawa | 346/140 R |
| 4,723,129 | 2/1988 | Endo et al. | 346/1.1 |
| 4,740,796 | 4/1988 | Endo et al. | 346/1.1 |
| 4,819,012 | 4/1989 | Kiyohara et al. . | |
| 4,959,662 | 9/1990 | Kobayashi | 346/1.1 |

FOREIGN PATENT DOCUMENTS

| | | |
|---|---|---|
| 59-123670 | 7/1984 | Japan . |
| 59-138461 | 8/1984 | Japan . |
| 60-162656 | 8/1985 | Japan . |
| 140341 | 2/1989 | Japan . |
| 2169855 | 7/1986 | United Kingdom . |
| 2184066 | 6/1987 | United Kingdom . |
| 2202800 | 10/1988 | United Kingdom . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

An ink jet recording apparatus includes a recording head for recording on a recording medium with the discharge of ink; a cap for covering a face of a recording head formed with a discharge port for discharging ink, the cap having an ink flow path with an ink suction port on an interior side thereof, and an ink exhaust port communicating with the ink suction port and located on the other side opposite to the ink suction port, the ink exhaust port of the ink flow path having an area smaller than that of the ink suction port; an ink absorbing member disposed within the cap, the ink absorbing member covering a part of the ink suction port, and maintaining the remaining part thereof open; and a suction device for exerting a suction force on the inside of the cap, the suction device communicating with the ink exhaust port.

14 Claims, 31 Drawing Sheets

HOME POSITION SWITCH
ON
OFF
CAP 51
ON
OFF
PUMP 53
UPPER DEAD CENTER
LOWER DEAD CENTER
BLADE 59
ON
OFF
0
90
180
270
360
36.6
54.1
4.3
4.0
145
168.5
250.3
295.0
193.4
5.0
109.5
130.5
155
185
209.5
230.5
290
IDLE SUCTION
VALVE OPEN
VALVE OPEN
VALVE FULL
VALVE CLOSE
VALVE FULL CLOSE
259.2
295
305
356.1
0
4.5
135
300
(A)
(B)
(C)
(D)
(E)
(F)

SUCTION RECOVERY DEVICE AND INK JET RECORDING APPARATUS WITH THE DEVICE

BACKGROUND OF THE INVENTION

1. Field of the Invention

The present invention relates to a suction recovery device which is applicable to a printer, a copying machine, facsimile terminal equipment, a typewriter, and a word processor that are generally used as business machines or an ink jet recording apparatus comprising complex equipment. This invention is also especially effective for an electronic typewriter having a word processing feature.

2. Related Background Art

A conventional arrangement of an absorbing member disposed within a cap is typically disclosed in U.S. Pat. No. 4,600,931. With this arrangement, a recording head is protected from drying out due to the heat insulating effect of the cap, because the ink absorbing member, impregnated with ink, is disposed within the cap which caps the recording head. Another arrangement in which an absorbing member is contained within a cap is known in U.S. Pat. No. 4,543,589.

Further, a capping device used in an ink jet recording apparatus is disclosed in British Laid-Open Patent Application No. 2,184,066, which discloses an ink suction port provided on a lower portion within a cap, and an ink absorbing member partially contained within the cap so as to entirely close the ink suction port therein.

Recently, however, recording time has increased, because ornamental characters or graphics are frequently recorded, for example, by a word processor. During such a long recording, the capping of the recording head may be often omitted. Moreover, the present inventor has found the following new problems from an investigation of these recording conditions.

As an ink absorbing ember disposed within a cop is subject to he atmosphere for a long time, it often occurs that the ink absorbed int eh ink absorbing member becomes dry. This drying may cause some amount of an additive contained in the ink, such as color or pigment, to stick to the absorbing member due to the evaporation of water or alcohol in the ink. Thus a new problem occurs that the gas permeability of the ink absorbing member deteriorates, thereby reducing the absorbing capability of the absorbing member.

The present inventor also examined another main method of ink recovery using a predischarge (which is described in detail in GB2169855), wherein the use of an idle suction (which is described in detail in U.S. Pat. No. 4,558,332) to suck and remove the ink makes the device more complex, resulting in the need for higher power consumption, or the need for a larger pumping power due to the increased volume of the absorbing member. The present inventor has developed this invention as a result of carrying out various experiments to enhance the ink retention capability of an ink absorbing member as much as possible.

SUMMARY OF THE INVENTION

It is an object of the present invention to provide a suction recovery device and an ink jet recording apparatus with such a device having a new construction within a cap in which the above-referred-to problems are substantially reduced or overcome.

It is another object of the invention to provide a suction recovery device and an ink jet recording apparatus provided with such a device which enables efficient recovery processing by reducing the number of idle suction operation and maintaining a suction power capable of discharging certain quantity of ink.

It is another object of the invention to provide a suction recovery device comprising a cap for covering a face of a recording head formed with a discharge port for discharging ink. The recording head records on a recording medium using the discharge of ink. The cap has an ink flow path containing an ink suction port on a interior side thereof, and an ink exhaust port communicating with the ink suction port and located on the other side opposite to the ink suction port the area of the ink exhaust port is smaller than that of the ink suction port. An ink absorbing member is disposed within the camp. The ink absorbing member covers part of the ink suction port, and maintains the remaining part thereof open. The device further comprises suction means for exerting a suction force on the inside of the cap, the suction means communicating with the ink exhaust port.

It is another object of the invention to provide a suction recovery device comprising a cap for covering a of a recording head formed with a discharge port for discharging ink. The recording head records a recording medium using discharge of ink. The cap has an ink suction port on an interior side thereof, the ink suction port being displaced downwardly from a central portion within the cap; and ink absorbing member disposed within the cap, the said ink absorbing member covering an upper side of the ink suction port, and maintaining a lower side thereof open.

Thus, in accordance with the invention, it is possible to achieve a significantly improved ink recovery ratio from a lower portion within a cap, and, at the same time, to provide an ink absorbing member having an enhanced ink retention capability, thereby maintaining an excellent condition within the cap.

It is another object of the invention to provide an ink jet recording apparatus comprising a recording head for recording a recording medium with the discharge of ink; a cap for covering a face of the recording head formed with a discharge port for discharging ink, the cap having an ink flow path with an ink suction port on an interior side thereof, and an ink exhaust port communicating with the ink suction port and located on the other side opposite to the ink suction port, the area of the ink exhaust port being smaller than that of the ink suction port; an ink absorbing member disposed within the cap, the ink absorbing member covering a part of the ink suction port, and maintaining the remaining part thereof open; and suction means for exerting a suction force on the inside of the cap, the suction means communicating with the ink exhaust port.

It is another object of the invention to provide an ink jet recording apparatus comprising a recording head for recording on a recording medium with the discharge of ink; a cap for covering a face formed with a discharge port for discharging the ink in the recording head, the cap having an ink suction port on an interior side thereof, the ink suction port being displaced downwardly from a central portion within the cap; and, an ink absorbing member disposed within the cap, the ink absorbing member covering an upper side of the ink suction port, and maintaining a lower side thereof open.

In accordance with the invention, it is possible to maintain a recording head in excellent condition, and prevent the ink from sticking to a portion thereof where the recording head is in contact with a cap.

DETAILED DESCRIPTION OF THE PREFERRED EMBODIMENT

An embodiment of this invention will be described in detail with reference to the annexed drawings.

Figure 1A:
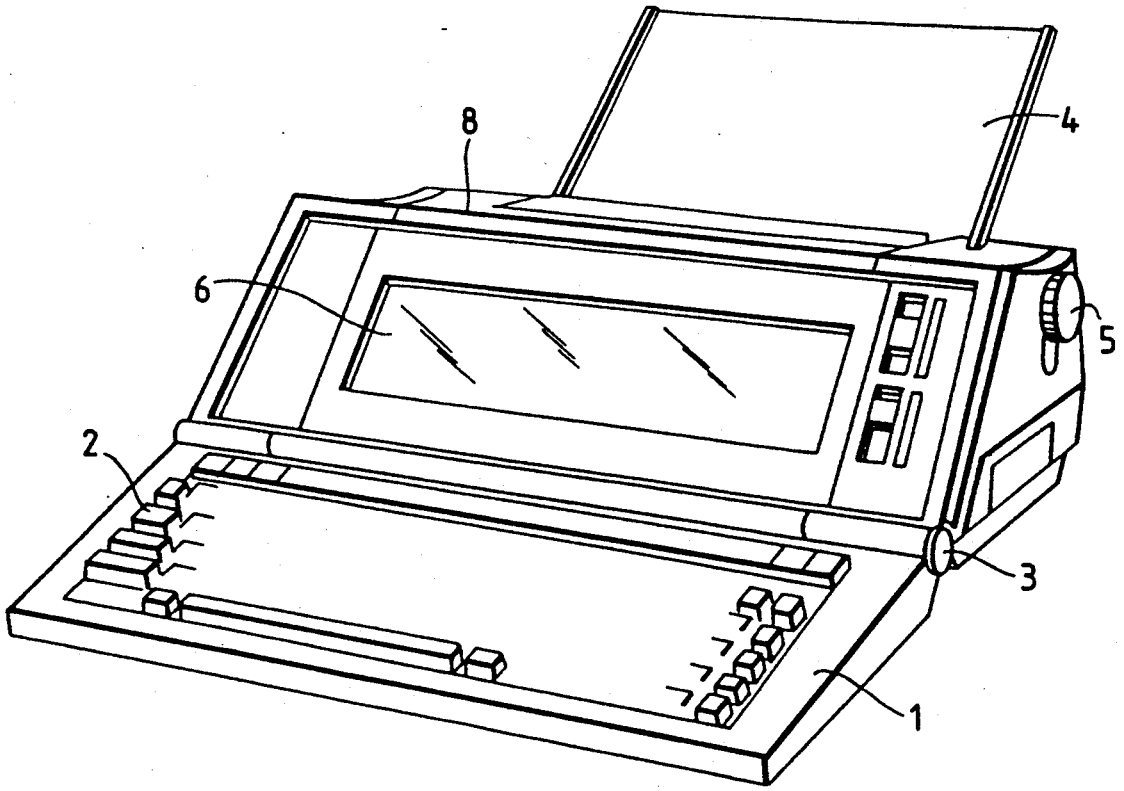
FIG. 1A is a perspective view of an electronic typewriter with a device according to an embodiment of this invention, when it is used.
Figure 1B:
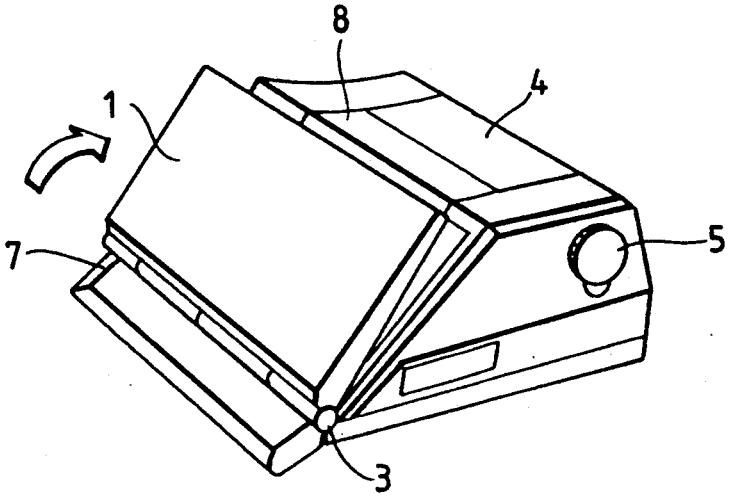
FIG. 1B is a perspective view of an electronic typewriter with a device according to an embodiment of this invention, when it is stored.

FIGS. 1A and 1B show a perspective view of an electronic typewriter with a device to which this invention denotes applicable. 1 is a keyboard, in which is arranged a group of keys 2, such as keys for entering characters, e.g. letters and numerals, a key for switching between a typewriter mode and a word processor mode, and control keys. When it is not used, it can be folded by turning it around a hinge 3, as shown in FIG. 1B. 4 denotes a feed paper tray for feeding a sheet-like recording medium onto a printer section within the apparatus, and can be also stored by folding over the printer section, as shown FIG. 1B, when not used. 5 denotes a feeder knob for setting or exhausting the recording medium manually, 6 denotes a display for displaying input sentences or other data, and 7 denotes a handle used to transport the apparatus in accordance with this invention.

8 denotes a window constituting a cover for the electronic typewriter in accordance with this invention, provided on an upper portion of the typewriter adjacent to the display 6, which enables a visual inspection of an ink jet printer and a recording medium that are accommodated therein, as described later.

Figure 2:
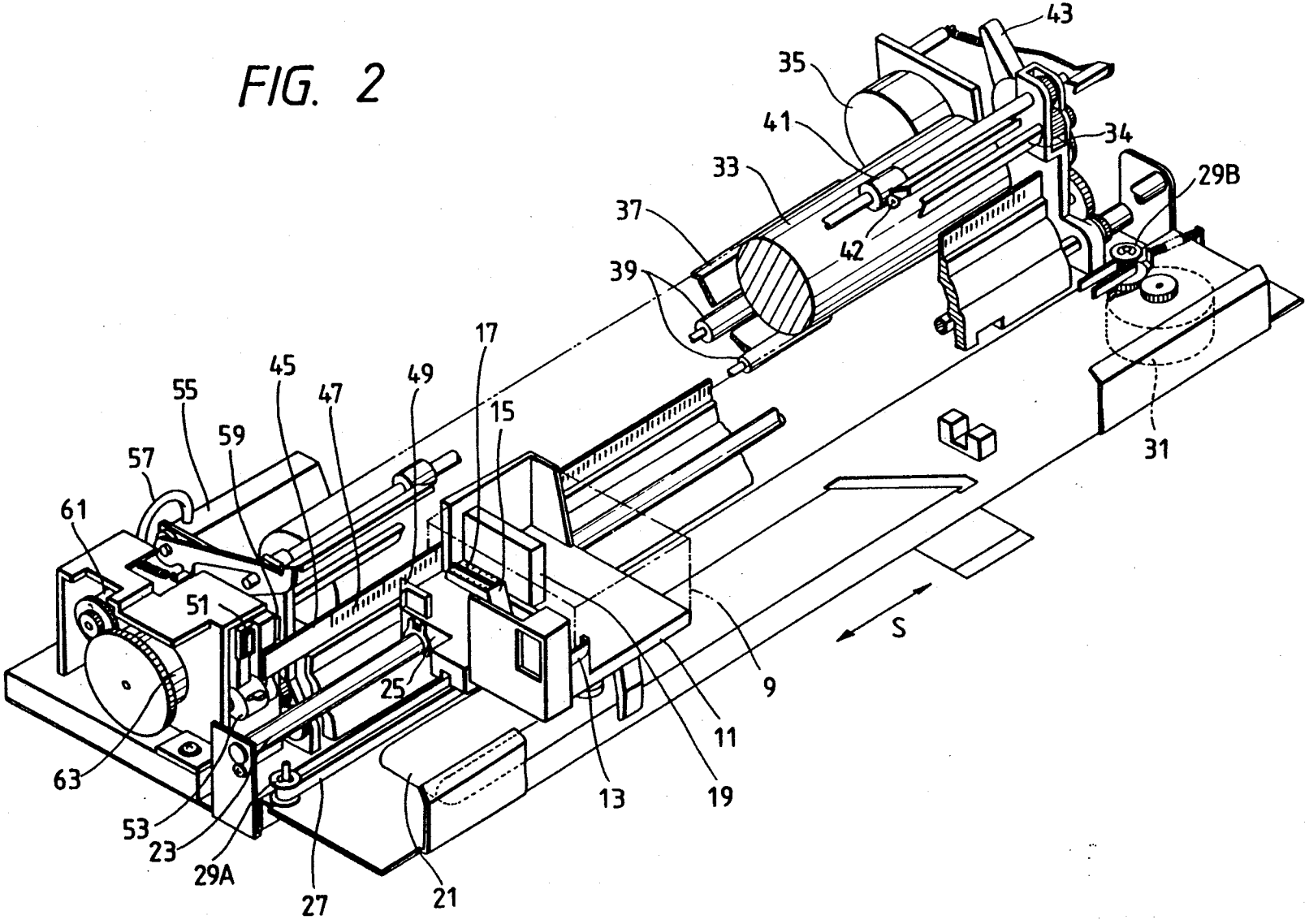
FIG. 2 is a perspective view showing a construction example of a printer applicable to an embodiment of this invention.

FIG. 2 shows the construction of a printer section according to an embodiment of this invention.

9 denotes a head cartridge having an ink jet recording head, as will be described in detail with reference to FIGS. 3 and 4, and 11 denotes a carriage for scanning in the S direction in FIG. 2 with the head cartridge 9 attached thereto. 13 denotes a hook for attaching the head cartridge 9 onto the carriage 11, and 15 denotes a lever for operating the hook 13. On this lever 15 is provided a marker 17 for enabling a print or set position of the recording head of the head cartridge to be read with an indication of scale provided on a cover as described later. 19 denotes a support plate for supporting an electrical connection to the head cartridge 9. 21 denotes a flexible cable for connecting the electrical connection and a control section of main body.

23 denotes a guide shaft for guiding the carriage 11 in the S direction, which is inserted through bearings 25 of the carriage 11. 27 denotes a timing belt for transmitting power to move the carriage 11 fixed thereto in the S direction, passing under tension about pulleys 29A, 29B arranged on both sides of the apparatus. A driving force is transmitted to one pulley 29B via a transmission means gear, by a carriage motor 31.

33 denotes a conveying roller for conveying a recording medium, e.g. a paper (thereafter referred to as a recording paper) on which recording occurs, as well as regulating the recorded plane of the recording medium, and it is driven by a conveying motor 35. 37 denotes a paper pan for conducting the recording medium from the feed paper tray 4 to a recording position, and 39 denotes a feed roller, disposed on a feed path for the recording medium, for biasing the recording medium against the conveying roller 33 to convey it. 34 denotes a platen for regulating a recording face of the recording medium, opposed to a discharge port of the head cartridge 9. 41 denotes a paper exhausting roller for exhausing the recording medium to a paper exhausting port, not shown, which is disposed downstream from the recording position in the direction of conveying the recording medium. 42 denotes a spur provided corresponding to the paper exhausting roller 41, for pressing the roller 41 via the recording medium, and developing a force for conveying the recording medium with the paper exhausting roller 41. 43 denotes a release lever for releasing the energized state for a feed roller 39, a presser bar 45, and a spur 42, when setting a recording medium.

45 denotes a presser bar for suppressing the floating of a recording medium in the neighborhood of a recording position to secure a tight contact condition against the conveying roller 33. In this embodiment, an ink jet recording head to record with the discharge of ink is used. Accordingly, as the distance between an ink discharge port formation face of the recording head and a recorded surface of the recording medium is relatively slight, and must be strictly controlled to avoid contact between them, the presser bar 45 is effectively disposed. 47 denotes a scale provided on the presser bar 45, and 49 denotes a mark provided on the carriage 11 corresponding to this scale, both enabling a print or set position for the recording head to be read.

51 denotes cap made of an elastic material, e.g. rubber, which is placed opposite to an ink discharge port formation face of the recording head in a home position, and supported so as to easily attach to/detach from the recording head. The cap 51 is used for protecting the recording head when it is not used, or in suction recovery processing for the recording head. The suction recovery process is such a processing that the cap 51 is opposed to the discharge port formation face, and the ink is discharged from the entire discharge port, by driving energy generation elements provided inwardly of the ink discharge port and used for the ink discharge, thereby discharging fault producing elements as a predischarge such as bubbles, dusts, or thickened ink not suitable for recording. These elements are removed by forceably discharging the ink from the discharge port, while the discharge port formation face is covered with the cap 51.

53 denotes a pump used to suck the ink received within the cap 51 in the suction recovery process with the forced discharge or predischarge, as well as to exert a suction force for the forced discharge of ink. 55 denotes a waste ink tank for reserving waste ink sucked by the pump 53, and 57 denotes a tube communicating between the pump 53 and the waste ink tank 55.

59 denotes a blade for wiping the discharge port formation face of the recording head, which is movably held between a position for wiping during the movement of head and projecting ink onto the recording head, and a retracted position not engaging the discharge port formation face. 61 denotes a motor, and 63 denotes a cam mechanism for driving the pump 53 and moving the cap 51 and the blade 59, with the power transmitted from the motor 61.

Next, a head cartridge 9 will be described in detail. FIG. 3 is a perspective view showing the head cartridge 9 integral with a discharge unit 9*a* that is an ink jet recording head body and an ink tank 9*b*, where 906*e* is a click engaged by a hook 13 on the carriage 11 in attaching the head cartridge 9. As clearly shown, the click 906*e* is disposed within a whole extension of the recording head. Near the discharge unit 9*a* in front of the head cartridge 9 is provided an abutting portion for positioning, not shown. 906*f* denotes a head opening section provided in a standing orientation on the carriage 11, to which a support plate for supporting a flexible substrate (electrical connection portion) and a rubber pad is inserted.

Figure 3:
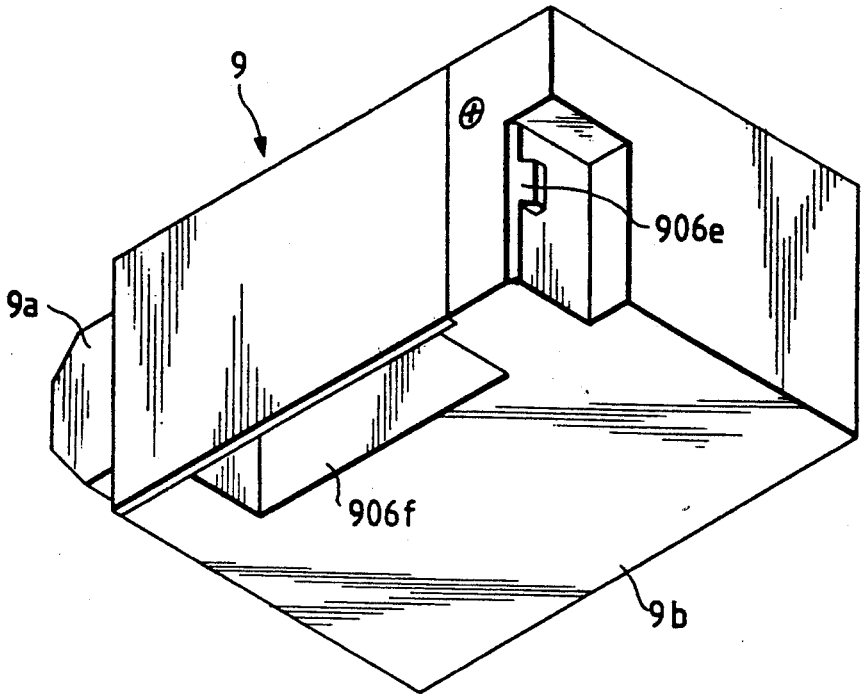
FIG. 3 is a perspective view of a head cartridge as shown in FIG. 2.
Figure 4B:
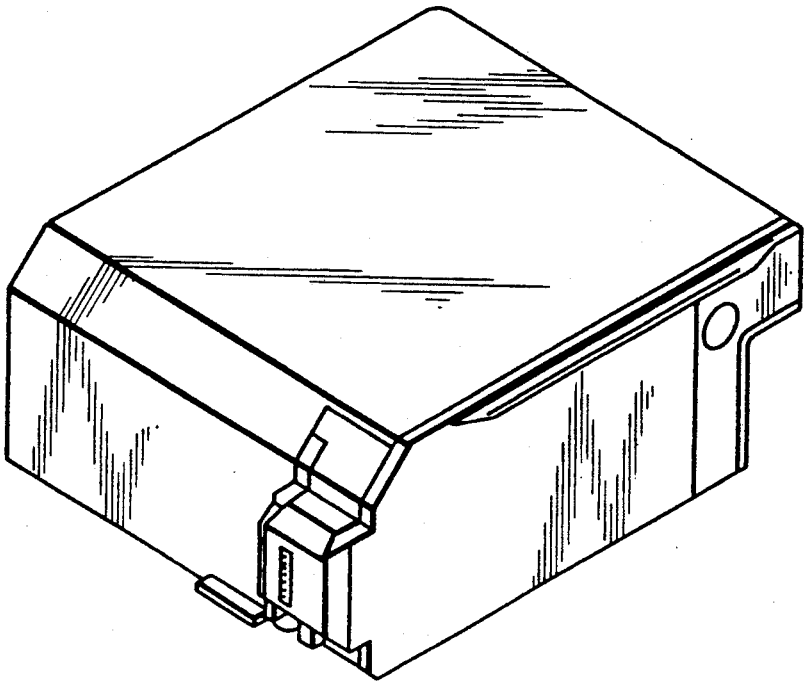
FIG. 4B is a perspective view of a a head cartridge as shown in FIG. 3.
Figure 4A:
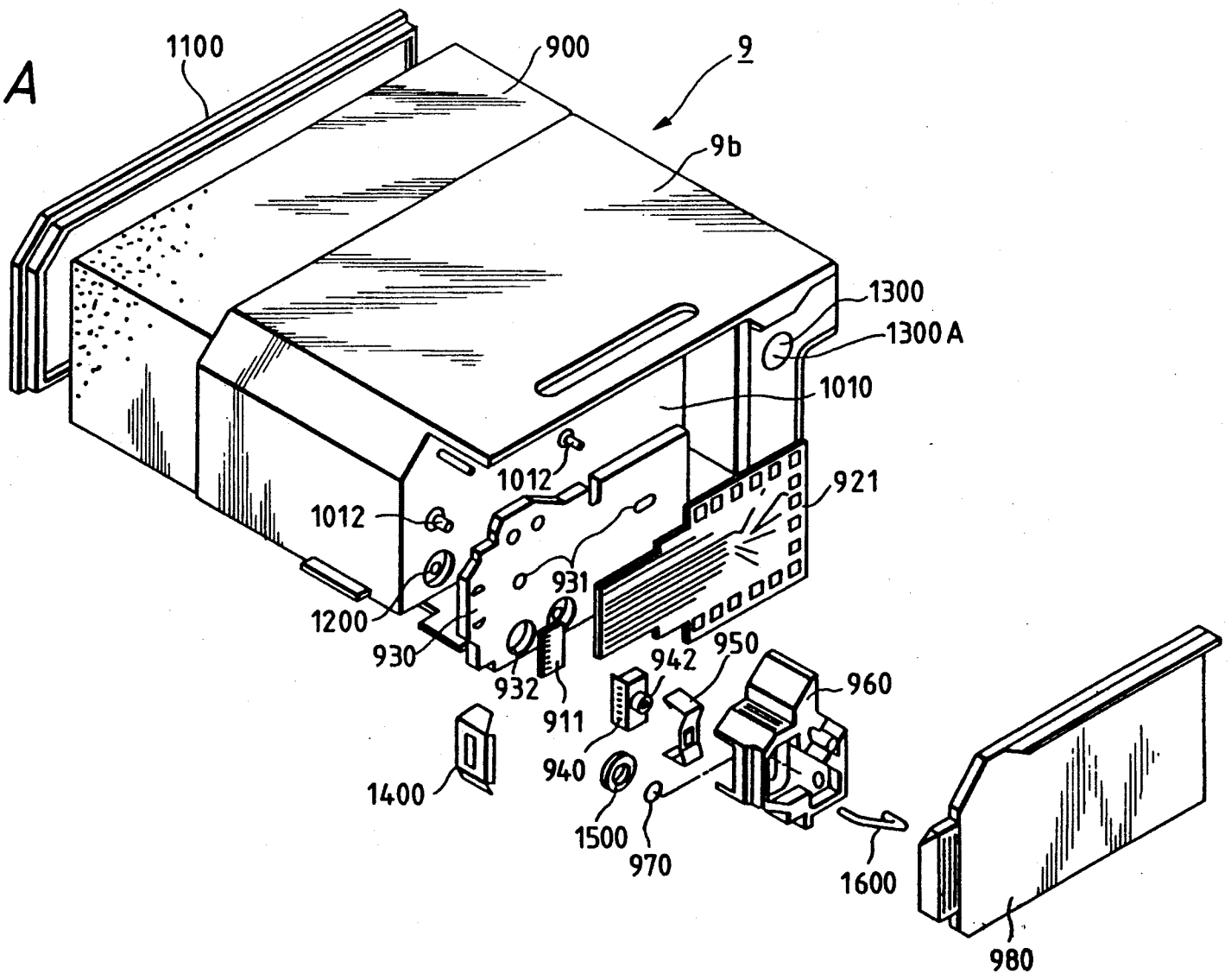
FIG. 4A is an exploded perspective view of a head cartridge as shown in FIG. 3.

FIGS. 4A and 4B are exploded perspective views showing the head cartridge as shown in FIG. 3, which is of a disposable type integrated with an ink reservoir section which is a supply source of ink, as described above. 911 denotes a heater board comprising an electricity heat conversion element (discharge heater) and wiring made of A1 for supplying the electric power, which are formed on an Si substrate with a film technique. 921 denotes a wiring substrate for the heater board, the corresponding wirings being connected with, for example, a wire bonding method.

940 denotes a roof plate provided with a diaphragm for restricting an ink flow path and a common liquid chamber, consisting of a resin material integrated with an orifice plate section in this embodiment.

930 denotes a carrier made of, for example, metal, and 950 denotes a presser spring, between which are engagingly carried the heater board 911 and the roof plate 940, which are thereby tightly fixed with the application force of the presser spring 950. It should be noted that the carrier 930 is pasted to the wiring substrate 921, and has a positioning reference with respect to the carriage 11 for scanning with the head. The carrier 930 also functions as a cooling member for radiating the heat on the heater board 911 generated by driving.

960 denotes a supply tank, which functions as a subtank for receiving ink from an ink reservoir **9*b* which is an ink supply source and for conducting ink into the common liquid chamber formed by the joint of the heater board 911 and the roof plate 940. 970 denotes a filter disposed in a position within the supply tank 960 near an ink supply port into the common liquid chamber, and 980 denotes a lid member for the supply tank 960**.

900 denotes an absorbing member for being impregnating with ink, disposed within the ink tank body **9*b*. 1200 denotes a supply port for supplying the ink to a recording element 9*a* comprising each of portions 911 ~ 980 as above indicated, for allowing the impregnation of ink into the absorbing member 900 by injecting the ink through the supply port 1200, in a process before this unit is placed on a portion 1010 of the ink tank body 9*b***.

1100 denotes a lid member for the cartridge body, and 1300 denotes an atmosphere communicating port provided on the lid member for communicating the inside of the cartridge to the atmosphere. 1300A denotes a liquid repellent member disposed inwardly of the atmosphere communicating port 1300, whereby the leakage of ink through the atmosphere communicating port 1300 is prevented.

After the ink is filled via the supply port 1200 into the ink tank **9*b*, the discharge unit 9*a* consisting of each of the portions 911~980 is positioned and disposed on the portion 1010. The positioning or fixing at this time can be performed, for example, by fitting a projection 1012 on the ink tank body 9*b* into a corresponding hole 931 on the carrier 930, thereby resulting in the head cartridge 9 as shown in FIG. 4B**.

And the ink is supplied from the inside of the cartridge through a supply port 1200, a hole 932 on the carrier 930 and an inlet port of the supply tank 960 as shown on a back side in FIG. 4A into the supply tank 960, and after passing through the inside of the supply tank 960, flows out of an outlet port through an appropriate supply tube and an inlet port 942 on the roof plate 940 into the inside of the common liquid chamber. At the connections for communicating the ink as indicated above, packings such as silicon rubber or butyl rubber are disposed, thereby sealing those connections to define an ink supply path.

Figure 5A:
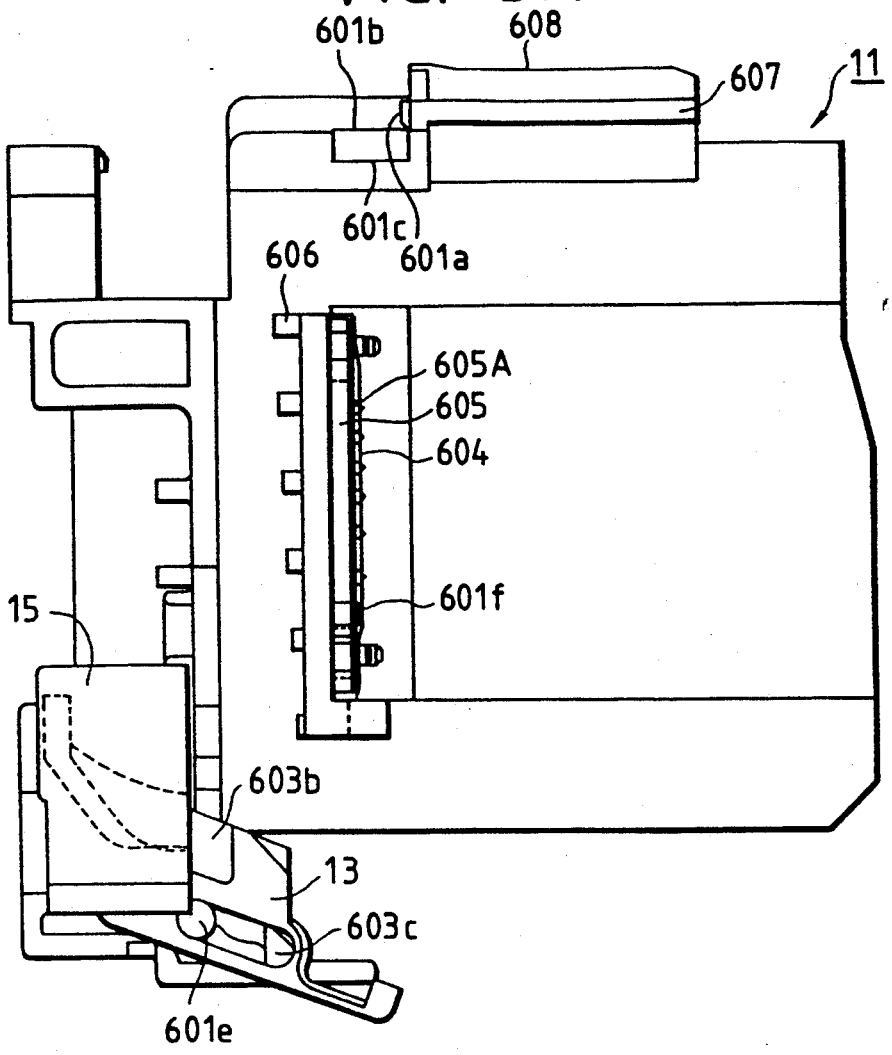
FIG. 5A is an upper view of a carriage as shown in FIG. 2.
Figure 5B:
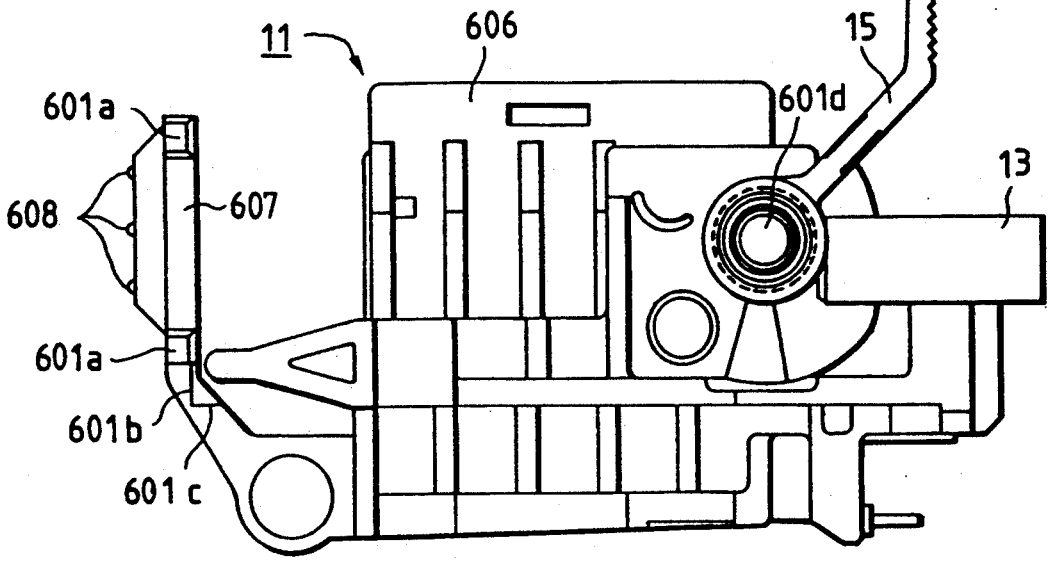
FIG. 5B is a side view of a carriage as shown in FIG. 2.

FIG. 5A and 5B are upper and side views showing a carriage 11 in detail, respectively.

606 denotes a support plate standing on a bottom portion of the carriage 11, for supporting a flexible substrate 604 and a rubber pad 605 having projection portions 605A corresponding to terminal pads formed in the substrate 604.

607 denotes an abutting member which also stands on the bottom portion in front of the carriage 11. The abutting member 607 is formed so that its wall thickness is thin, in order to preserve the largest possible space for the ink tank within a limited range of space for disposing both the head cartridge 9 and the carriage 11. Hence, on the member 607 are formed three ribs 608 to improve the strength thereof. The extending direction of the ribs 608 is the movement direction of the carriage 11 so as to have a sufficient strength to withstand the movement of the head cartridge in the swivel direction when it is detached The ribs 608 are formed to be about 0.1 mm forwardly of the discharge face when the head cartridge 9 is attached. As a result, even when the recording paper protrudes toward the travel path of the recording head with any action, the recording paper is prevented from rubbing against the discharge face, which could cause damage.

An operation lever 15 for attaching or detaching the head cartridge freely rotatably bears on a shaft **601*d* on the carriage body 11. A hook 13 is used to attach or detach the head cartridge 9, a portion of which is in engagement with a portion of the operation lever 15. The hook 13 can perform the above mentioned attaching or detaching operation by guiding a long hole 603*c* formed therein into a guide shaft 601*c* on the carriage body 11**.

As the attaching or detaching mechanism consisting of the operation lever 15 and the hook 13 is provided laterally of the carriage 11, or at the side toward which the carriage 11 moves, the attaching or detaching mechanism does not create any large dead space due to the movement of the carriage.

Next, an abutting portion used to position the head cartridge when attaching thereto will be described.

**601*a* denotes abutting portions for positioning the head cartridge in the left and right directions, provided at two locations on the both sides of an abutting member 607. It should be noted that for positioning the head cartridge in the left and right directions, an abutting portion 601*f* on the support plate 606 may be also used, in addition to the abutting portions 601*a***.

**601*b* denotes an abutting portion to position it in the forward and backward directions, formed in a lateral underside portion of the abutting member 607**.

**601*c* denotes abutting portions to position it in the upper and lower directions, formed at two locations, i.e., in a lateral underside portion of the abutting member 607** and a lateral underside portion of the support plate.

Figure 6A:
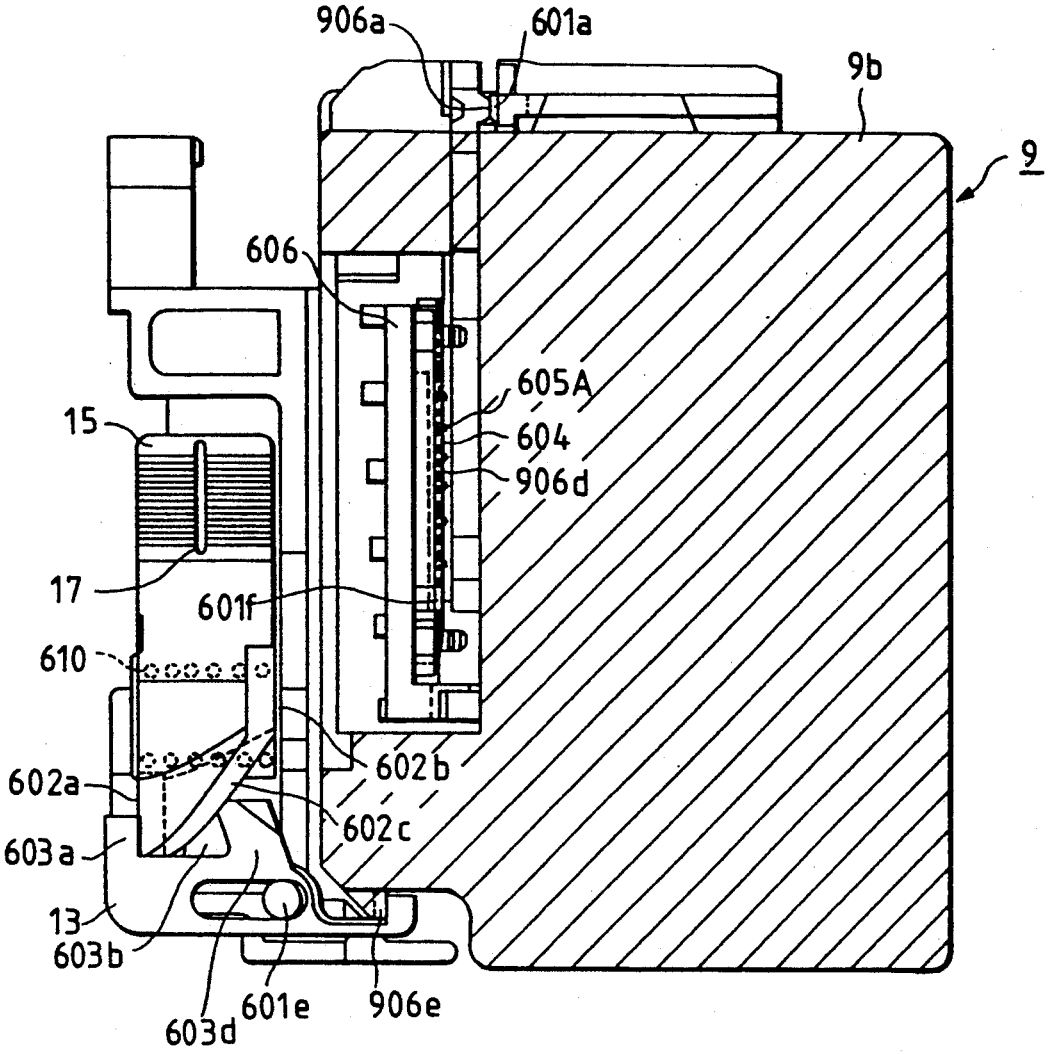
FIG. 6A is an upper view of the carriage with the head cartridge mounted thereon.
Figure 6B:
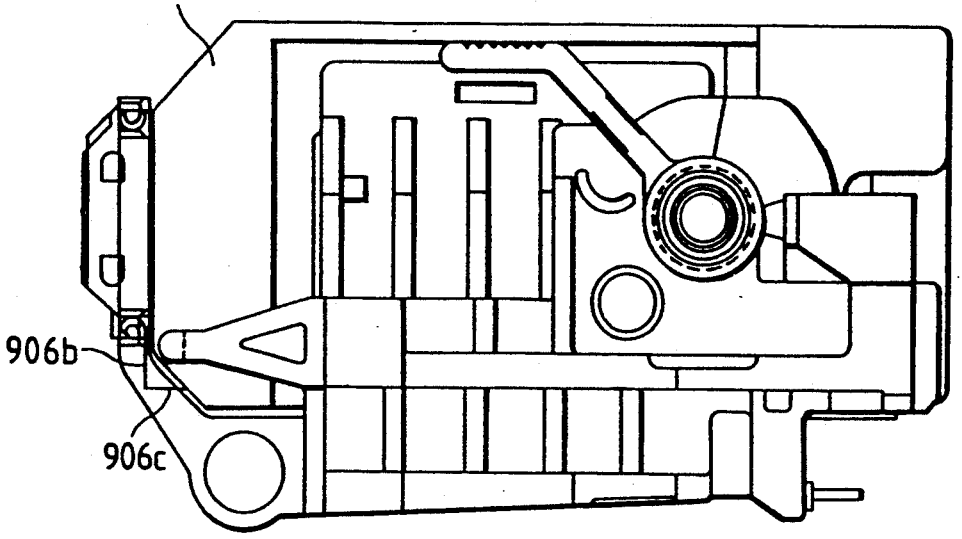
FIG. 6B is a side view of the carriage with the head cartridge mounted thereon.

FIGS. 6A and 6B are upper and left side views showing the state when the head cartridge 9 is attached onto the carriage 11, respectively.

In FIGS. 6A and 6B, **906*a* denotes a direct contact portion provided on the head cartridge 9 so as to come into contact with an butting portion of the carriage 11, when the recording head is attached, while 906*b* and 906*c* are also direct contact portions corresponding to the abutting portions 601*b* and 601*c***, respectively.

Referring now to FIG. 6A, the engagement relations between various portions when the recording head is attached will be outlined.

The contact portion 906*a* of the head cartridge 9 is directly in contact with the abutting portion 601*a* of the carriage 6, while simultaneously the click 906 of the head cartridge 9 is forced to the left side in FIG. 6A, with the energized force of a coil spring 610 against the hook 13 engaged therein, whereby the head cartridge 9 is subject to the moment force around the above mentioned direct contact portion. Then a substrate 906*d* on the head is brought into direct contact with the abutting portion 601*f*, so that the head cartridge 9 can be positioned in both left and right directions, thereby holding that position.

At this time, the projection portion 605A of the rubber pad 605 is compressed by coming into direct contact with the substrate 906*d*. This deformation causes a force pressing a terminal pad of the flexible substrate 604 into contact with a terminal of the substrate 906*d*, in which as the substrate 906*d*, is in direct contact with the abutting portion 601*f*, the amount of deformation for the projection portion 605A is kept constant, thereby causing a stable pressing force as indicated above.

In the FIG. 6A, the compressed state of the projection portion 605A is not shown.

The forward or backward and upper or lower positioning for the head cartridge 9 can be performed in an attaching process.

Figure 7A:
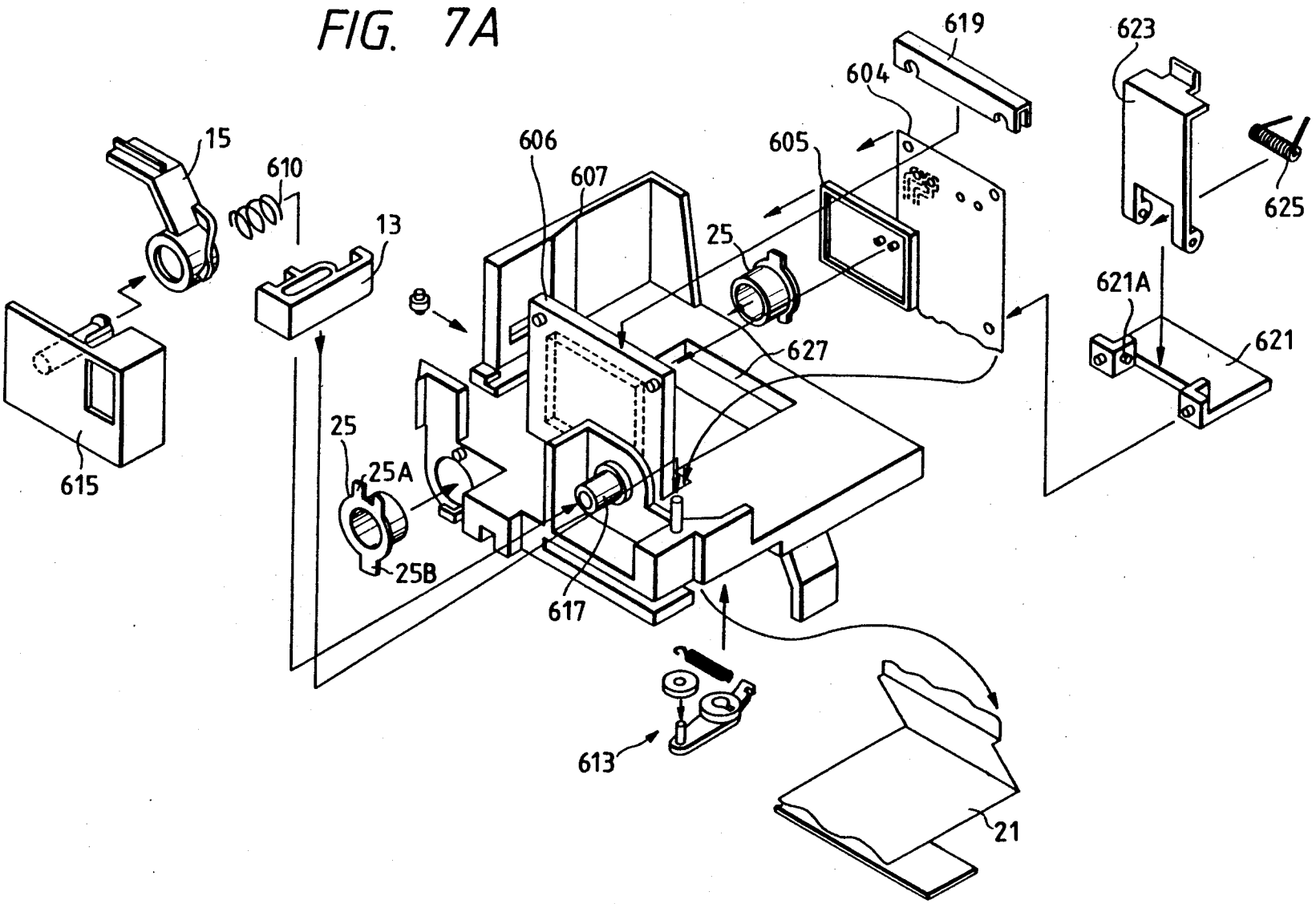
FIG. 7A is an exploded perspective view of the carriage.

FIG. 7A is an exploded perspective view of the above mentioned carriage 11.

Here, 613 denotes a roller spring as described later, and 615 denotes a lever stop for mounting an operation lever 15 onto a mounting portion 617 on the carriage 11. 619, provided at one end portion of a flexible cable 21, denotes a mounting member for fixing upper edge portions of a flexible substrate 604 and a rubber pad 605 integrated therewith in this embodiment to the support plate 606, while 621 is also a mounting member for fixing lower edge portions thereof.

In addition to the construction as above mentioned, a substrate cover 623 is provided for covering the flexible substrate 604 on the carriage side when the head cartridge 9 is not attached, and protecting the flexible substrate 604 and a circuit within the main body connected thereto, from a contact with hands of an operator and a breakage due to said contact or an action of an electrostatic force. This substrate cover 623 is rotatably secured into pins 621A on the lower edge portion mounting member 621 for the substrate. 625 denotes a spring for exerting a tendency to rotate the substrate cover 623 toward the direction of covering the flexible substrate 604, and 627 denotes a recess for housing the substrate cover 623 when the head cartridge 9 is attached.

Figure 7B:
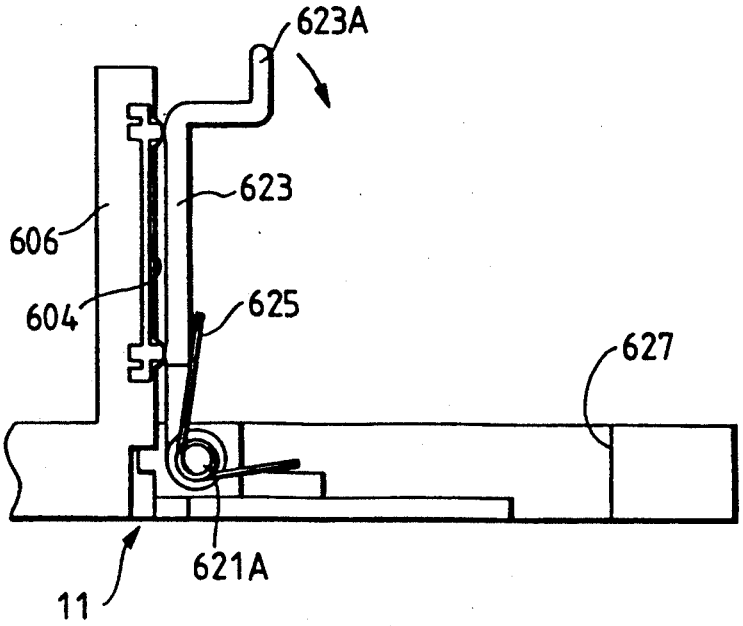
FIG. 7B is a side view of the carriage.
Figure 7C:
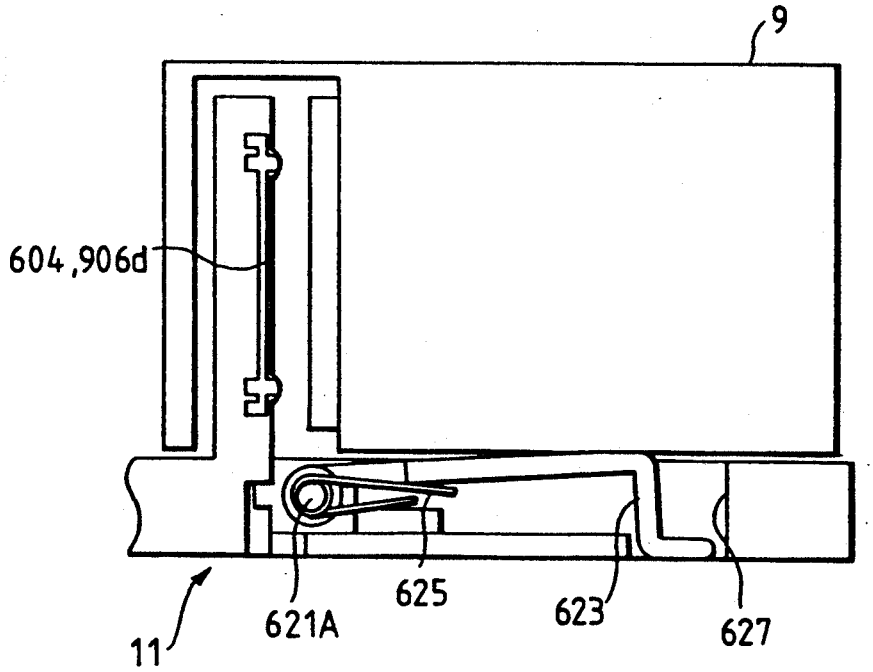
FIG. 7C is a side view of the carriage with the head cartridge mounted thereon.

Referring now to FIGS. 7B and 7C, the operation of the substrate cover 623 will be described. When a head cartridge 9 is not attached, the substrate cover 623 covers a flexible substrate 604 with a biasing force of a spring 625, as shown in FIG. 7B. If the head cartridge 9 is attached from an upper side in the above state, the substrate cover 623 is rotated clockwise in FIG. 7B around pins 621A against the biasing force of the spring 625, with the engagement between the lower surface of the head cartridge and a cover operation portion 623A, or the engagement between an operator hand and the operation portion 623A. And if the head cartridge 9 is completely attached, and the substrate 604 is placed in direct contact with the substrate 906*d* on the head side, the cover 623 is housed in the recess 627 by being pressed against the lower surface of the head cartridge 9. It should be noted that if the head cartridge 9 is removed, the cover immediately returns to the state as shown in FIG. 7B, thereby protecting the substrate 604.

Figure 8A:
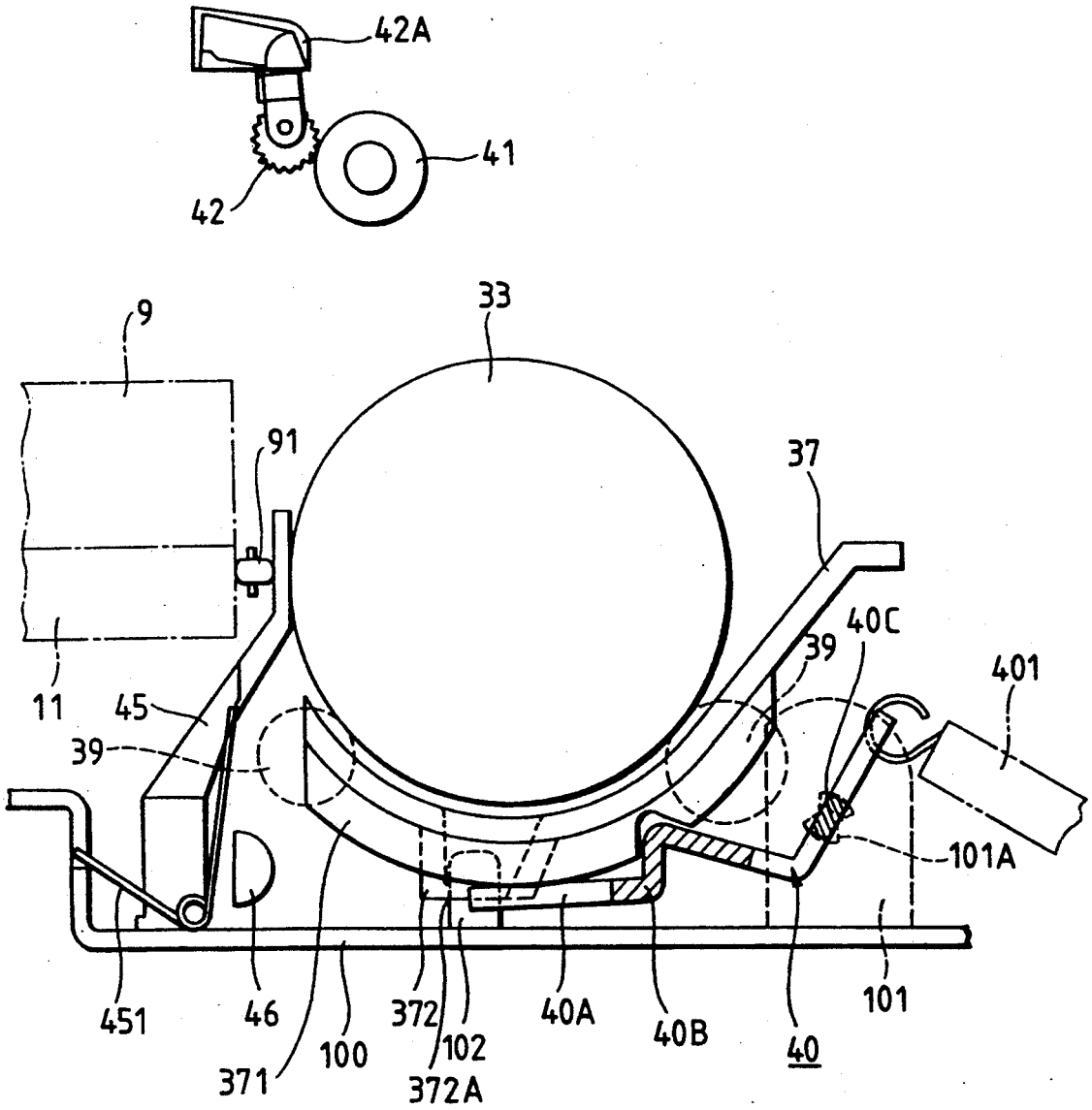
FIG. 8A is a cross-sectional side view of a recording medium conveying system on a printer as shown in FIG. 2.

FIG. 8A is a typical side view for mainly showing a recording medium conveying system of the apparatus as shown in FIG. 2.

FIG. 8A shows an arrangement of each of elements in normally conveying a recording medium. The recording medium fed from a feed paper formed not shown is introduced into a conveying path formed between a conveying roller 33 and a paper pan 37. In this conveying path, the recording medium is conveyed with the friction force between the conveying roller 33 and the recording medium, based on the pressing force of the feed roller 39, by the conveying roller 33 rotating clockwise in FIG. 8A. Thereafter, the recording medium is introduced between the conveying roller 33 and a paper presser bar 45, and then also conveyed with the friction force between the conveying roller 33 and the recording medium, based on the pressing force of the paper presser bar 45. Further, the recording medium is regulated in the direction by the paper presser bar 45, and conveyed along a platen 34 between a paper exhausting roller 41 and a spur 42, while the recording medium is recorded on with the discharge of ink droplet from a recording head cartridge 9.

Figure 8B:
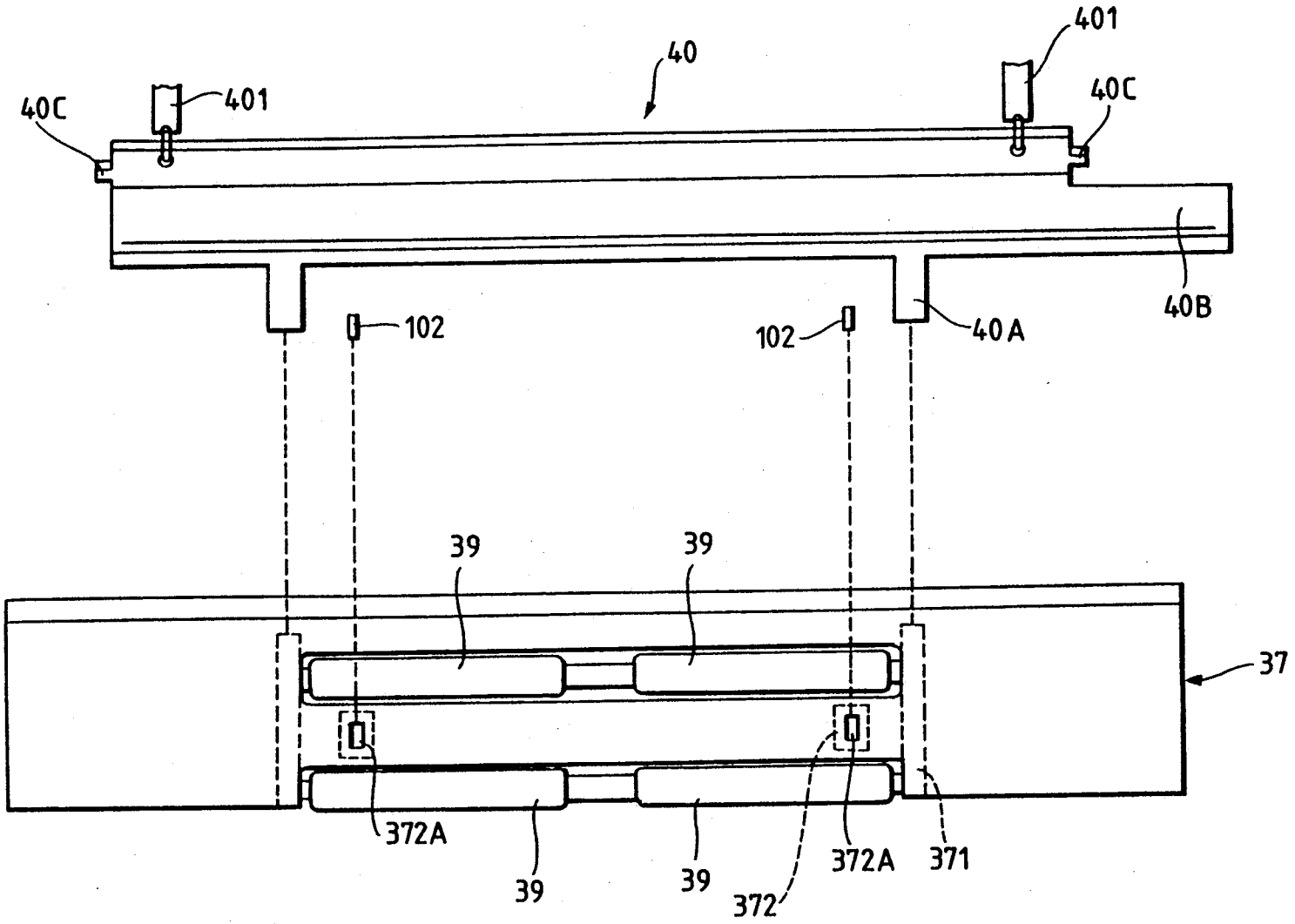
FIG. 8B is an exploded upper view of a recording medium conveying system on a printer as shown in FIG. 2.

FIG. 8B is a top view showing a paper pan 37, and a release plate for forcing it in the direction toward the conveying roller 33, which are separated for clarity of explanation.

Referring now to FIGS. 8A and 8B, the mechanism for conveying a recording medium will be described. 40 is a release plate which is a member for pressing a feed roller 39 to a conveying roller 33 via a paper pan 37, and releasing that pressing force The release plate 40 rotatably bears on an axis such that axis portions 40C provided on the ends thereof are in engagement with axis holes 101A on an axis member 101 on which the release plate 40 rotatably bears stood on a bottom plate 100 of the mechanism, so that this portion is forced obliquely in the right lower direction by a spring 401 engaging at two positions in one end portion of the release plate 40, the release plate 40 bearing on the axis portion 40C to be rotatable clockwise, as shown in FIG. 8A. 371 denotes ribs provided at two locations underneath the paper pan 37. The ribs 371 are brought into contact with the pressing portion 40A during the above rotation of the release, plate 40 and pressed upwardly in FIG. 8A. As a result the feeder roller 39 which bears on the ribs 371 presses the conveying roller 33.

The release of pressing force with the release plate 40 is performed in such a way that a shoulder 40B extending at one end of the release plate 40 is pressed downwardly in FIG. 8A against the rotation force owing to a spring 401. If this pressing force is released, the paper pan 37 and the feed roller 39 move downwardly by their weight, thereby providing a predefined amount of space between the feed roller 39 and the conveying roller 33.

327 denotes a rectangular projection portion formed when a portion of the paper pan 37 extends downwardly. In the projection portion 372 is provided a rectangular hole 372A, which engages a projection 102 upstanding on the bottom plate 100 with a predetermined amount of space. With this engagement, the positioning of the paper pan 37, and hence the feed roller 39 with respect to the conveying roller 33 can be performed.

Figure 9A:
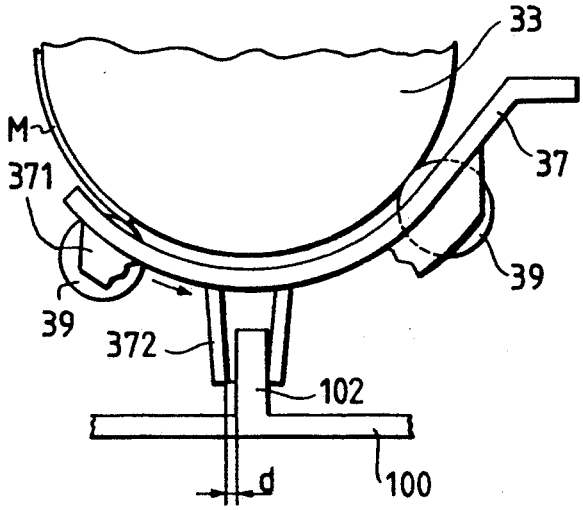
FIGS. 9A and 9B are typical side views showing the configuration for the run off of a feed roller in the conveying system.
Figure 9B:
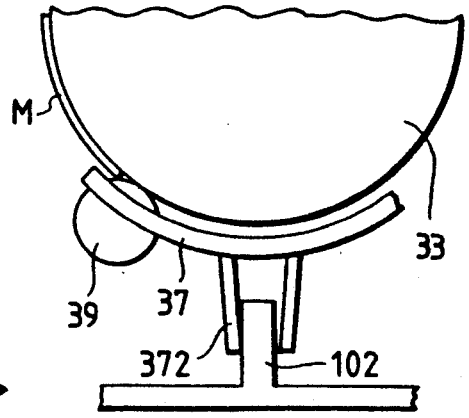

With such an arrangement in which there is looseness in the the adverse effect due to so called above-described engagement of elements kicking, which occurs when a trailing portion of a recording medium M to be conveyed passes through the feed roller 39, can be eliminated. While the recording medium M is transferred from the state where a trailing portion of the recording medium is pressed against the conveying roller 33 by the feed roller 39 as shown in FIG. 9A, to the state where the feed roller 39 and the conveying roller 33 are in direct contact with each other as shown in FIG. 9B, it is forced out between the feed roller 39 and the conveying roller 33, in which even if the recording medium M is an envelope or a cardboard, such a kicking phenomenon is never caused by the force exerting on various portions in forcing the recording medium out. For example, in the arrangement where the feed roller 39 can not escape in a reverse direction with respect to the direction of forcing the recording medium out, the conveying roller 33 is rotated to convey it a longer distance than a predetermined amount because of forcing it out. Consequently, the recording position on the recording medium.

In the arrangement in accordance with this embodiment as shown in FIG. 8A, FIGS. 9A and 9B, on the other hand, because the paper pan can escape by a distance d in the above engagement in the right these figures, when the trailing portion of the recording medium is forced out, the force due to the extrusion will not be exerted on the recording medium and the conveying roller 33, so that the above-mentioned problem does not occur.

Referring now to FIG. 8A again, 451 denotes a spring for forcing the paper presser bar 45 in the direction toward the platen 33. The spring 451 has one end thereof extending from the coil-shaped portion engaged with a portion of the paper presser bar 45, and has the other end engaging a portion of the bottom plate 100 of the mechanism. The coil-shaped portion bears on a portion of the bottom plate 100. The paper presser bar 45 is pressed via a roller 91 on a leading portion of the carriage 11 against the carriage 11, as described later. The distance between a discharge port of the head cartridge 9 and a recording surface of the recording medium can be properly maintained by the pressing force via the roller 91 by the spring 45.

The paper presser bar 45 also exerts the pressing force on the conveying roller 33 via the recording medium due to the pressing force as above described, thereby conveying the recording medium with a friction force between the recording medium and the conveying roller 33 based on that pressing force.

Here, to convey, successfully various types of recording media, it is necessary to make appropriate the friction force between the paper presser bar and the recording medium, and between the conveying roller and the recording medium. In other words, it is desirable that the friction force between the paper presser bar and the recording medium is as small as possible, while that between the conveying roller and the recording medium is as large as possible.

Further, it is also desired to make the friction force between the paper presser bar and the conveying roller as small as possible. This is because if that friction force is large, the motor load becomes large at a so-called idle feeding. If a predetermined gap is provided between the paper presser bar and the conveying roller to avoid it, the precision control becomes difficult with respect to the pressing force of the recording medium against the platen.

Hence, in this embodiment, the material of the paper presser bar 45 is POM (polyacetal), and that of the conveying roller 33 is CR (chloroprene rubber, hardness 60 degrees / A scale) mixed with 5~10% (weight ratio) of monofilament of nylon resin). Fluororesin can be also used for paper presser bar 45.

It should be noted that the hardness of the above mentioned chloroprene rubber was 60 degrees, but if it is within a range of 50 and 70 degrees, it does not have an adverse effect on the conveyance of the recording paper. It is not necessary that the conveying roller 33 and the paper presser, bar 45 are entirely made of above materials, but only the direct contact portions may be constructed of the above materials, or further the paper presser bar and the conveying roller can be formed by pasting a sheet member of the above material onto the body portion.

As the friction coefficient between the paper presser bar 45 and the recording medium can be reduced by constructing the paper presser bar and the conveying roller with the above materials, such an arrangement as above described that the paper presser bar 45 presses against the conveying roller 33 can be embodied as described above. Consequently, the distance between the recording medium and the head cartridge can be controlled more easily than the previous arrangement which did not allow various paper thicknesses for the recording medium. As the friction coefficient between the recording medium and the conveying roller is larger, sliding does not occur during the conveyance, whereby the successful conveyance of the recording medium can be accomplished.

In FIG. 8A, 46 denotes a shaft member which extends parallel to the paper presser bar 45, and on both ends of which bears a frame of device, with its cross-section being a D character shaped. When a recording medium is conveyed, the rotation position is determined so that a straight portion of the D character is placed in a longitudinal direction (from the upper to the lower portion in FIG. 8A). On the other hand, when the pressing force of the paper presser bar 45 against the conveying roller 33 is released, as shown in FIGS. 10 and 11, the straight portion of the paper presser bar is directed transversely (from the left to the right direction in FIG. 8A) so as to come into direct contact with a portion of the spring 451, so that the spring is displaced, thereby releasing the engagement between the spring 451 and the paper presser bar 45. Thus, the pressing force is only released without changing the position of the paper presser bar 45.

Consequently, even if the carriage is operated with the pressing force being released due to the insertion of a recording medium, the head cartridge and the carriage does not interfere with the paper presser bar to thereby damage the head cartridge and the carriage. In other words, it is possible to perform various operations by moving the carriage, even while the pressing force of the paper presser bar is being released. The pressing force against the paper presser bar 45 via the roller 91 is not released in this case, but this pressing force is directed to one point of a portion where the paper presser bar 45 is opposed to the carriage 11, and so it does not present any problem for inserting the recording medium.

In FIG. 8A, 41 denotes a paper exhausting roller, with which a spur 42 engages. The spur 42 is energized against the paper exhausting roller 41 by the energizing means as shown in FIGS. 10 and 11, in which the recording medium can be also conveyed with the friction force between the recording medium and the paper exhausting roller 41, based on that pressing force, as noted previously. The spur 42 is energized via a holding member 42A against the paper exhausting roller 41 as above described, and released from the engagement with the paper exhausting roller 41, by detaching it from the paper exhausting roller 41 via the holding member 42A.

Figure 8C:
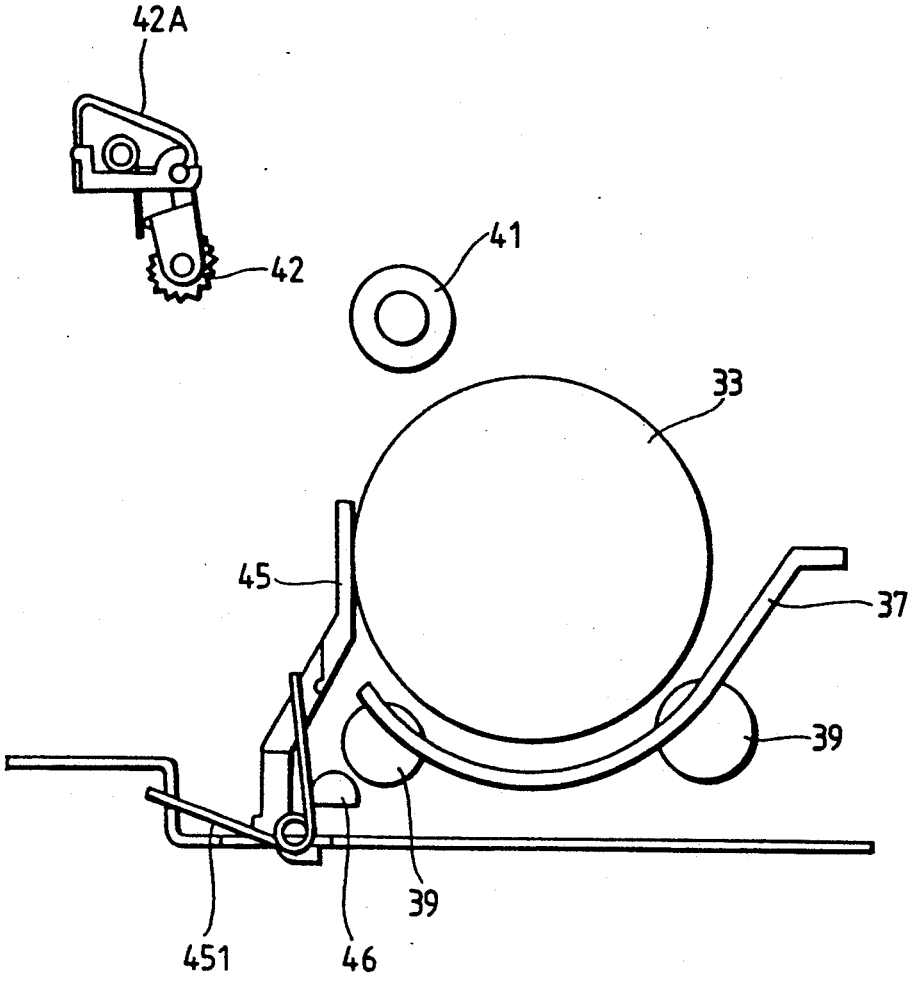
FIG. 8C is a cross-sectional side view of the conveying system with each energizing force released.

As described above, the paper pan 37 (feed roller 39), the paper presser bar 45 and the spur 42 as shown in FIGS. 8A and 8B can release their energizing force in their respective manners. Those releases can be performed simultaneously by the operation of a release lever 43 as shown in FIG. 2, so that the state as shown in FIG. 8C occurs.

Figure 10A:
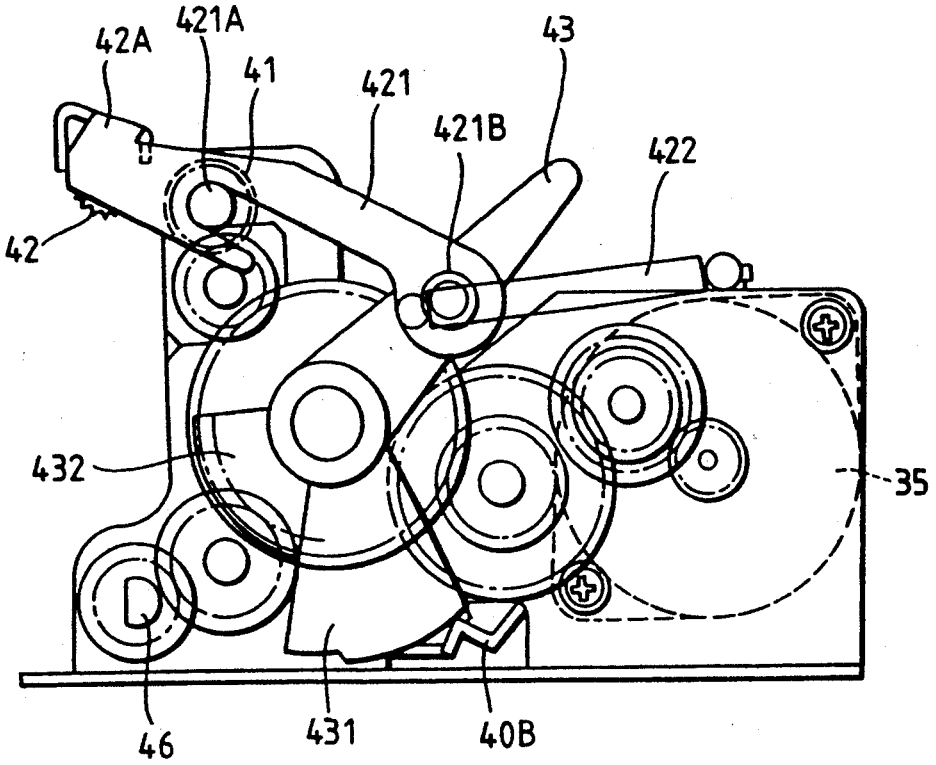
FIG. 10A is a side view of portions disposed on the right hand side of a device in a mechanism for releasing the energized state of a feed roller, a paper presser bar and a spur on the conveying system, before releasing it.
Figure 10B:
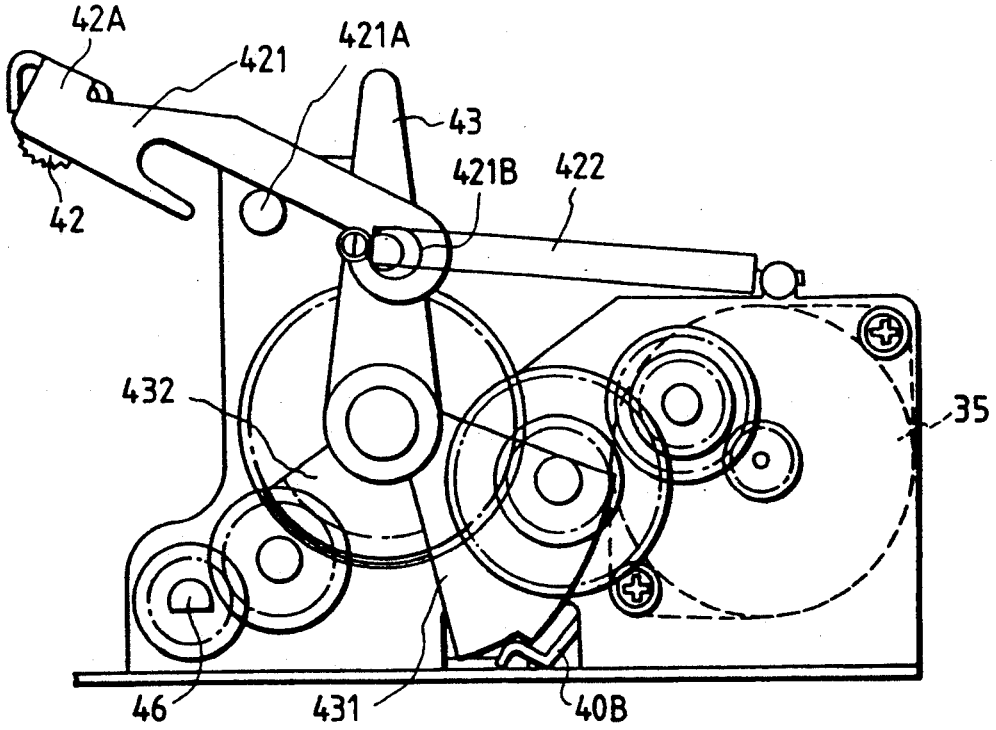
FIG. 10B is a side view of portions disposed on the right hand side of a device in a mechanism for releasing the energized state of a feed roller, a paper presser bar and a spur on the conveying system, after releasing it.
Figure 11A:
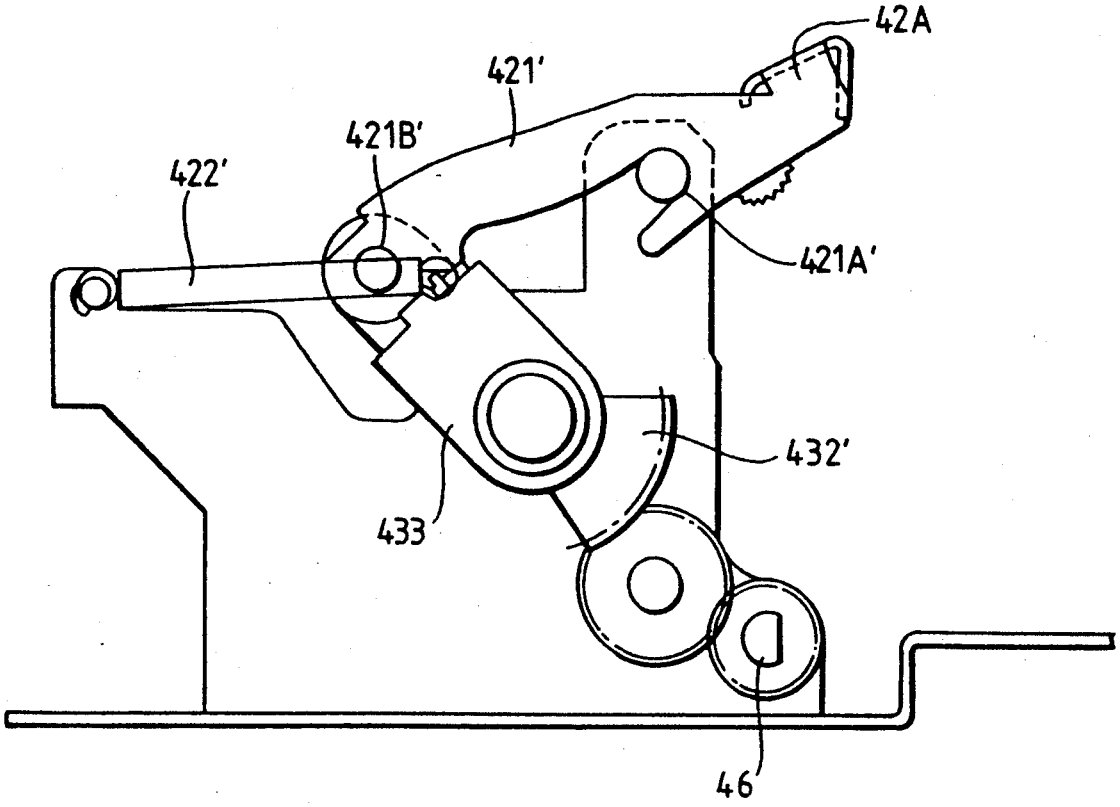
FIG. 11A is a side view of portions disposed on the left hand side of the same device, before releasing it.
Figure 11B:
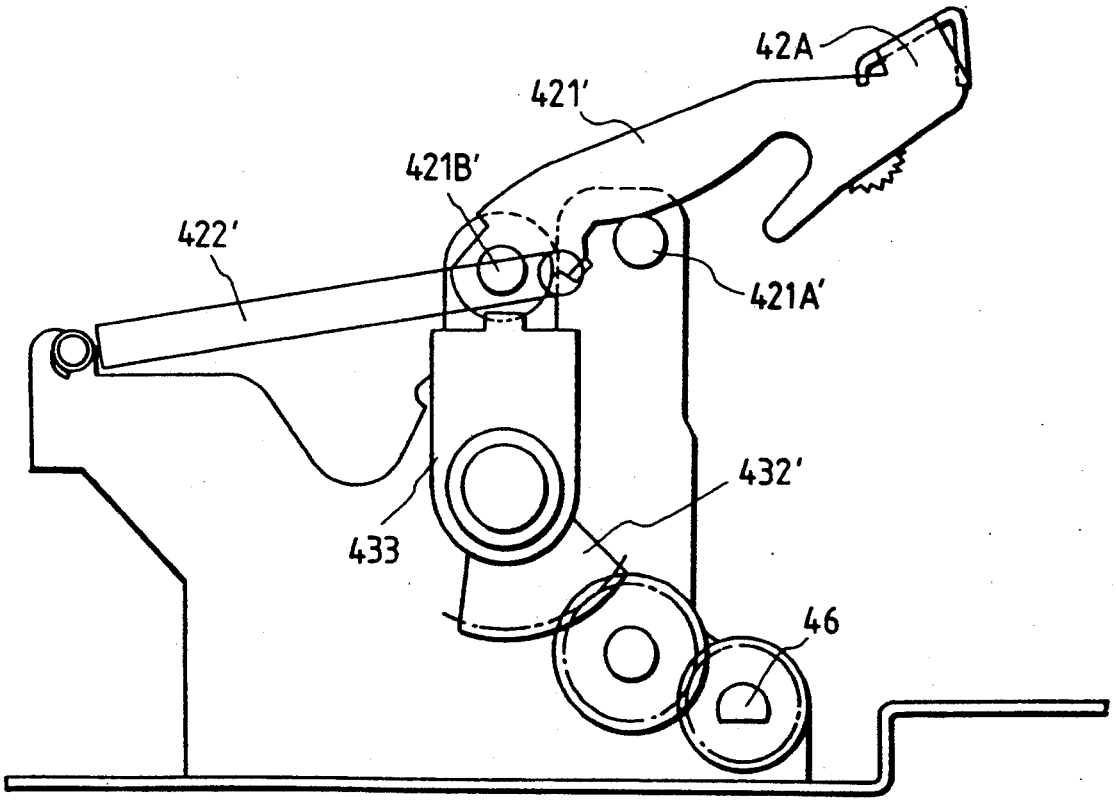
FIG. 11B is a side view of portions disposed on the left hand side of the same device, after releasing it.

FIGS. 10A and 10B, and FIGS. 11A and 11B are view showing a mechanism for releasing the above mentioned energizing force as indicated above, in which FIGS. 10A and 10B show that mechanism on a recording apparatus viewed from the right side, while FIGS. 11A and 11B show the same viewed from the left.

FIG. 10A and FIG. 11A show a normal state where the energizing force in conveying a recording medium is not released. Then the release lever 43 which rotatably bears on a shaft of the conveying roller 33 is placed in a laid down position due to the energizing force of a spring as described later, so that a cam member 431 fixed to the lever 43, a gear 432, and a gear 432' disposed on the other end portion opposite to the end portion at which the lever 43 is disposed, and fixed to the shaft coaxial with that of the conveying roller 33, are in engagement with a shoulder portion 40B of the release plate 40 and a train of gears for rotating a shaft member 46, in the predetermined positional relations. Spur arms 421 and 421' extending from the spur holding member 42 and disposed on both end portions thereof are forced backwardly of the device via the respective engagement portions 421B and 421B' in engagement with the lever 43 and the connection member 433, by the tensile forces of the springs 422 and 422'. In this energized condition, the engagement portions 421A and 421A' on the respective spur arms can engage with the shaft of the paper exhausting roller 41, so that the appropriate engagement between the spur 42 and the paper exhausting roller 41 have the proper position and the pressing force can be generated.

As the engagement of the spur arms 421 with the release lever 43 is accomplished with a predetermined amount of looseness, the appropriate engagement of the spur 42 with the paper exhausting roller 41 can be performed without the need for great precision in shape for the spur arms 421.

The rotation of the release lever 43 is transmitted via a gear 432 and a train of intermediate gears to the shaft member 46, and therefrom to a train of intermediate gears and a gear 432' on the opposite side, and the connection member 433, finally moving the spur arm 421'. In this case, the looseness due to the backlash between gears interposed therein can be absorbed by the engagement with a looseness between the release lever 43 and the spur arm 421 as shown above.

It should be noted that a member that can be released from the energized condition with the above construction is not limited to the spur, but may be any type of roller for conveying a recording medium.

FIGS. 10B and 11B show the state where the spur 42, the paper presser, bar 45 and the paper pan 37 are released from their respective energizing states. These releasing operations can be accomplished by rotating the release lever 43 forwardly of the device against the tensile force of the spring 422. In other words, if the release lever 43 is rotated, the gear 432 is rotated accordingly. Then, as described above, the shaft member 46 is rotated via the train of intermediate gears in engagement with the gear 432, thereby making the straight line portion of the D shaped character assume a cross-wise position, so that the shaft member 46 forces the spring 451 in the direction for narrowing the spring 451, as described above in FIG. 8A, thus releasing the engagement between the spring 451 and the paper presser bar 45 so as to eliminate the energizing force for the paper presser bar 45.

Along with the rotation of the release lever 43, a cam 431 can be rotated. With a cam portion of the cam member 431 is engaged the shoulder portion B of the release plate 40, as described above in FIG. 8, which lowers its position along with the rotation of the cam member 431, releasing the engagement with the ribs 371 of the paper pan 37, and hence pressing against the ribs 371. Consequently, the force for energizing the paper pan 37 (feed roller 39) to the conveying roller 33 is released, and the paper pan 37 is lowered downwardly by its weight. With the rotation of the release lever 43, the shoulder portion 40B and the step-like cam portion of the cam member 431 are finally engaged, so that the engagement position thereof is fixed, and thereby, the rotational position of the release lever 43 is fixed.

Further, with the rotation of the release lever 43, the spur arm 421 moves forwardly of the device, and with the transmission of the rotation via the shaft member 46, as described above, the spur arm 421' on the opposite end portion moves forwardly of the device, whereby the spur 42 connecting to the spur arms 421, 421' is released from engagement with the paper exhausting roller 41.

In this way, the release of the energizing force owing to the paper pan, the paper presser bar and the spur, can be accomplished by one rotation of the release lever, and with a simple construction.

Figure 12:
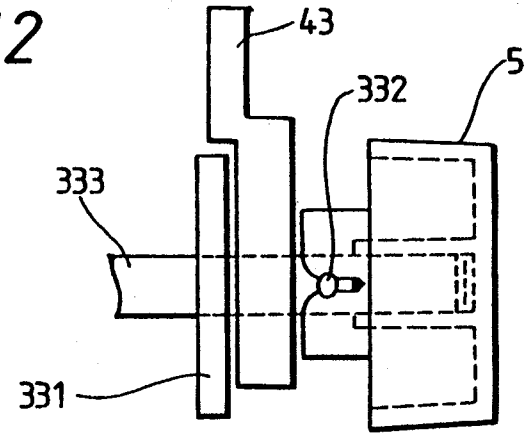
FIG. 12 is a typical front view showing the engagement between a lever and a knob which are used to release the energized state.
Figure 13:
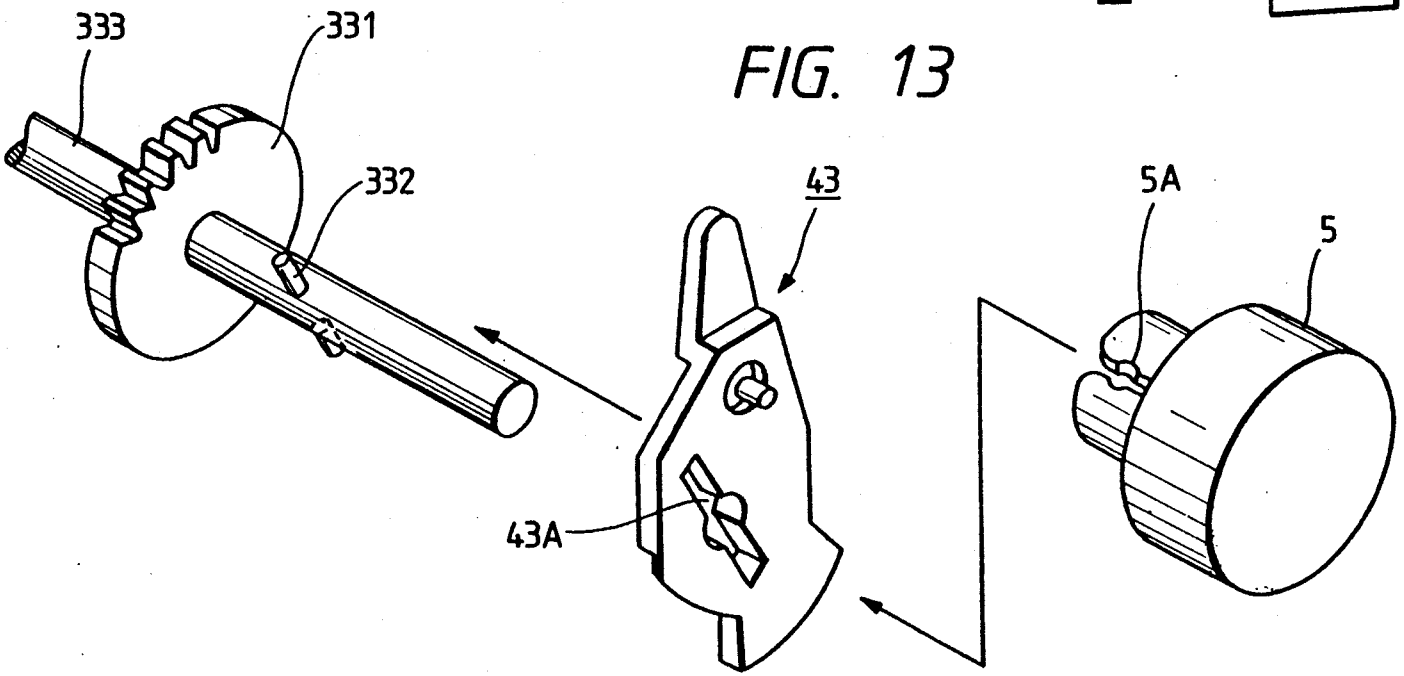
FIG. 13 is an exploded perspective view of a mechanism as shown in FIG. 12.

FIG. 12 is a typical front view showing a knob fixed to the shaft of the conveying roller 33 and an assembled state of the release lever as above mentioned, and FIG. 13 is a typical exploded view. In FIG. 12, a driven gear 331 for rotating a conveying roller 33 is fixed to a shaft 333 of the conveying roller 33, while a knob 5 is fixed to the shaft 333 by a spring pin 332 driven into the shaft 333. The release lever 43 freely rotatably bears on the shaft between them, but has a restricted range of rotation with a spring, as described above.

FIG. 13 is a view for explaining a sequence of assembling the above construction. As shown, in FIG. 13, the spring pin 332 has been driven into the shaft 333 beforehand, to which a gear is fixed. The release lever 43 is inserted into the shaft 333 in this state via an open section 43A. The open section 43A has such shape that the shaft 333 and the spring pin 332 can be passed therethrough, as shown in FIG. 13, whereby the release lever 43 can move beyond a position where the spring pin 332 was driven to the side of gear 331. Thereafter a knob 44 is fixed by fitting the spring pin 332 into a slit 5A while inserting the knob 5 into the shaft 333.

With the above construction, the axial movement of the release lever 43 can be restricted by means of the gear 331 and the knob 5, and the knob 44 can be fixed by means of the spring pin 332. As the spring pin 332 is driven beforehand into the shaft 333, the assembling is simpler than the case where the spring pin is driven into shaft 333 after inserting the lever.

Figure 14:
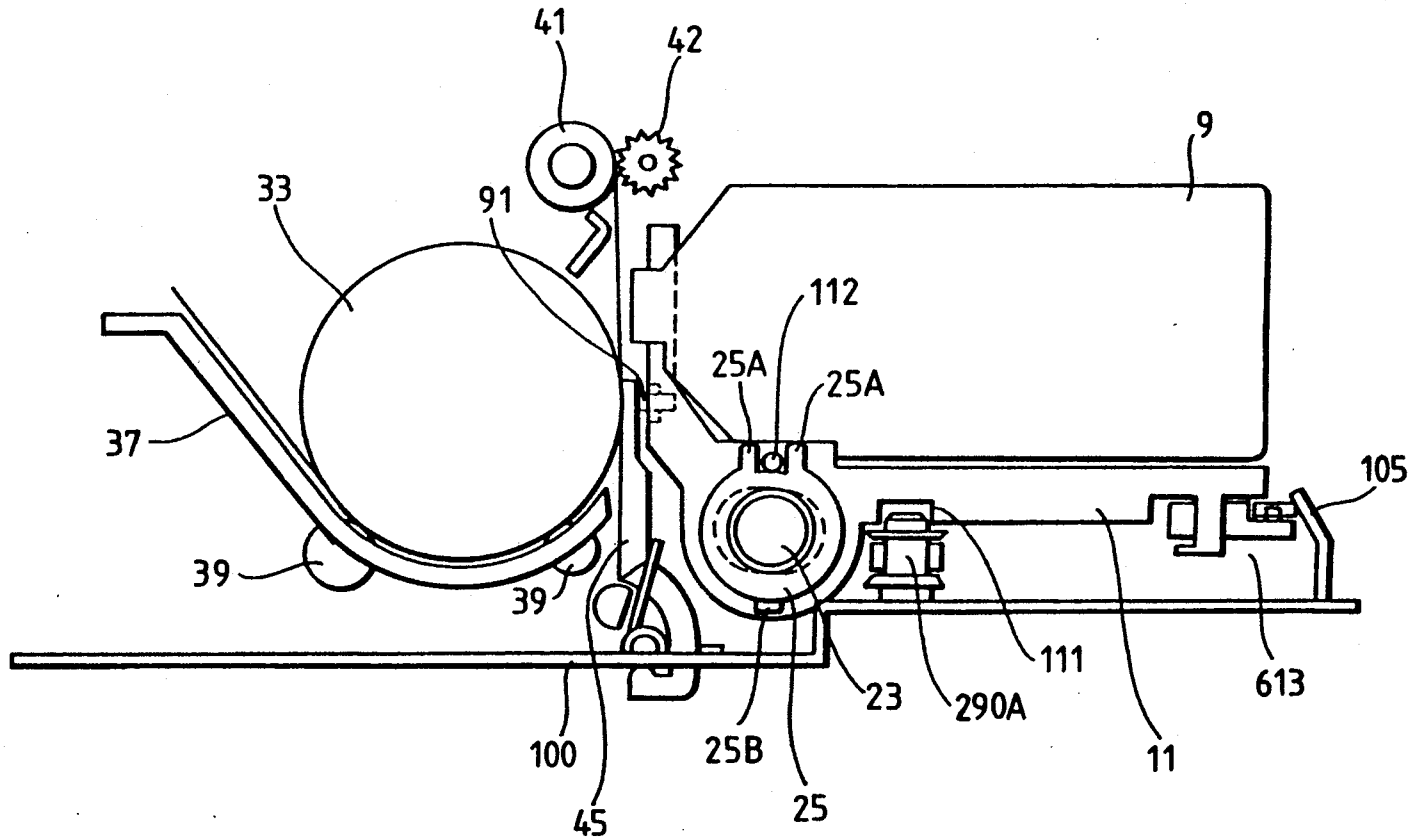
FIG. 14 is a side view showing the engagement relation of the carriage with other elements.
Figure 15:
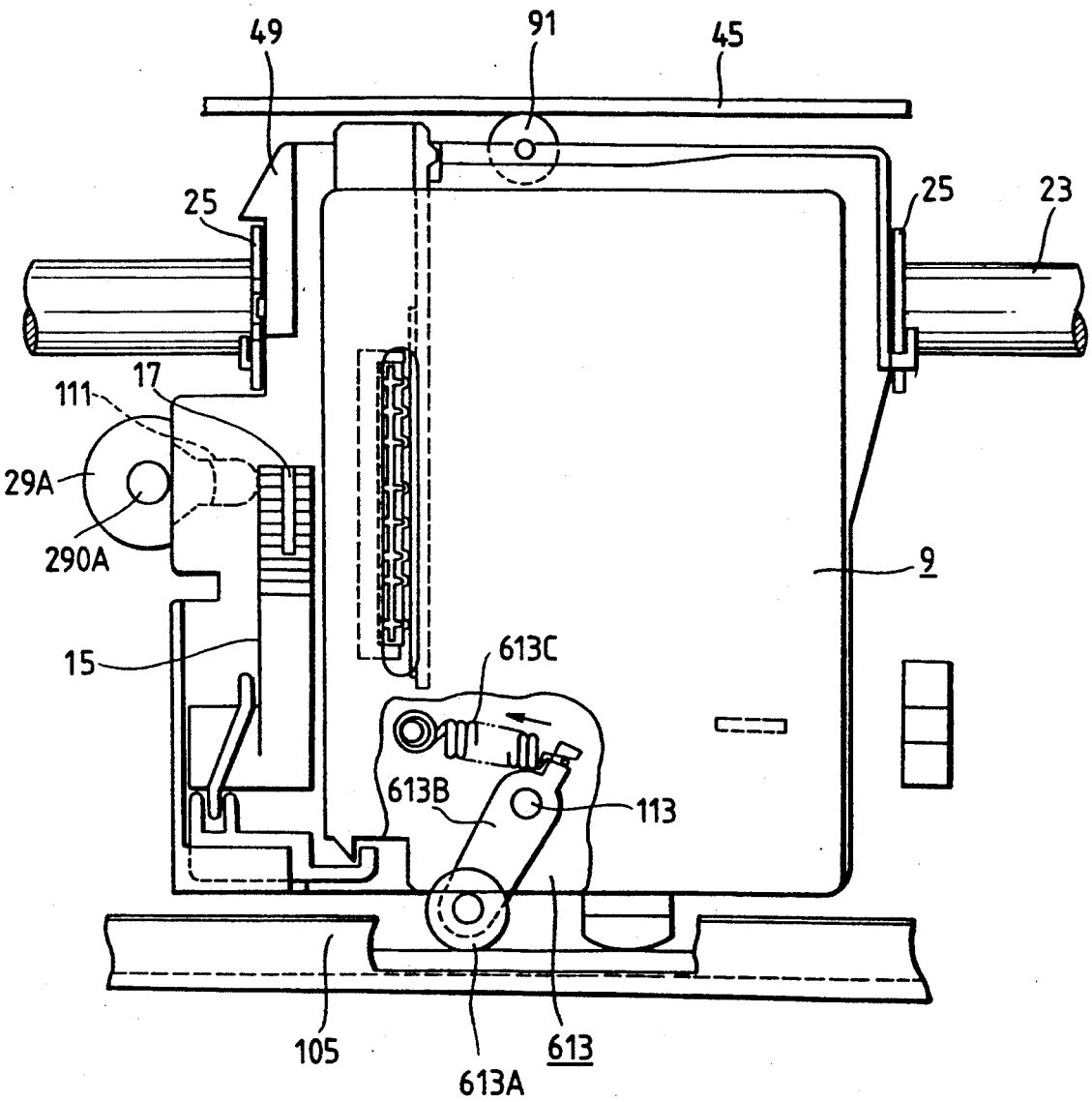
FIG. 15 is an upper view showing the engagement relation of the carriage with other elements.

FIGS. 14 and 15 are side and upper views showing the mechanism around a head cartridge as shown in FIG. 2. 91 denotes a roller which freely rotatably bears on a shaft on a front end portion of the carriage 11, as previously described. The roller 91 is provided such that a portion thereof may project forwardly of a discharge port face of the head cartridge, rotating in direct contact with a paper presser bar 45. 613 denotes a roller spring provided on a trailing portion of the carriage 11. The roller spring 613 is comprised of a roller 613A, a connection member 613B which bears on the roller 613A, and a spring 613C for energizing the connection member 613B in a predetermined rotational direction. The roller 613A is brought into direct contact with a front end plate 105 standing and extending parallel to a guide shaft as previously described at the front end portion of a bottom plate 100 in the device, on which it rolls. The connection member 613B freely rotatably bears on a predetermined shaft 113 of the carriage 11, while the spring 613C is carried on a predetermined axis to force the connection member 613B to rotate counterclockwise around the shaft 113. With the above construction of the roller spring 613, the carriage 11 is always forced toward a paper presser bar 45.

25 denotes bearings for engaging with a guide shaft 23, mounted on both side end portions of the carriage 11. The bearings 25 have a bearing portion eccentric to a case to be mounted, in which two bearings 25 are mounted with the eccentric direction being opposite to each other. The bearing 25 on the side as shown in FIG. 14 is provided to swing around a boss 112 on the carriage 11. That is, portions in the carriage 11 to which the bearings 25 are mounted are formed with long holes, and two projections 25A of the bearings 25 are regulated in a forward or backward direction of (the left or right direction in FIG. 14) movement by the boss 112. Consequently, the bearings 25 swing relative to the carriage 11, in correspondence with the movement of the carriage 11, as described later. The movement of the bearings 25 in the direction of the guide shaft 23 is regulated to a part of the carriage 11 (refer to FIG. 7A) by a projection 25B on the bearings 25.

Figure 16B:
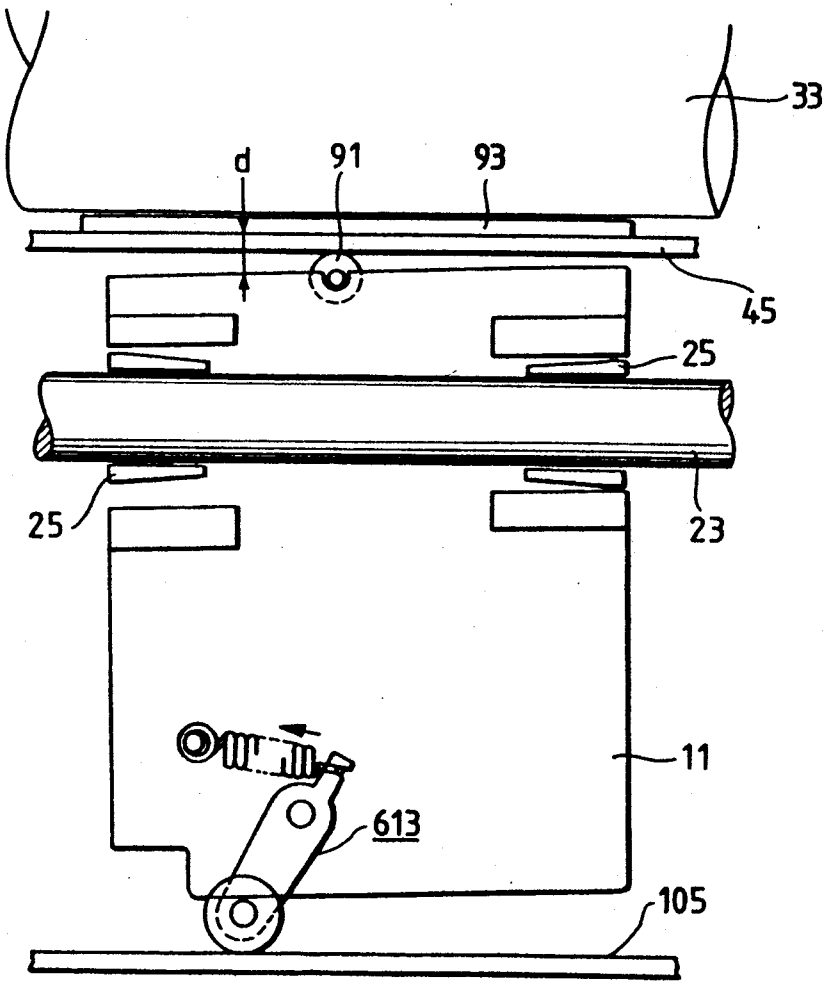
FIGS. 16A and 16B are typical upper views showing how the carriage changes its position depending on the thickness of a recording medium.
Figure 16A:
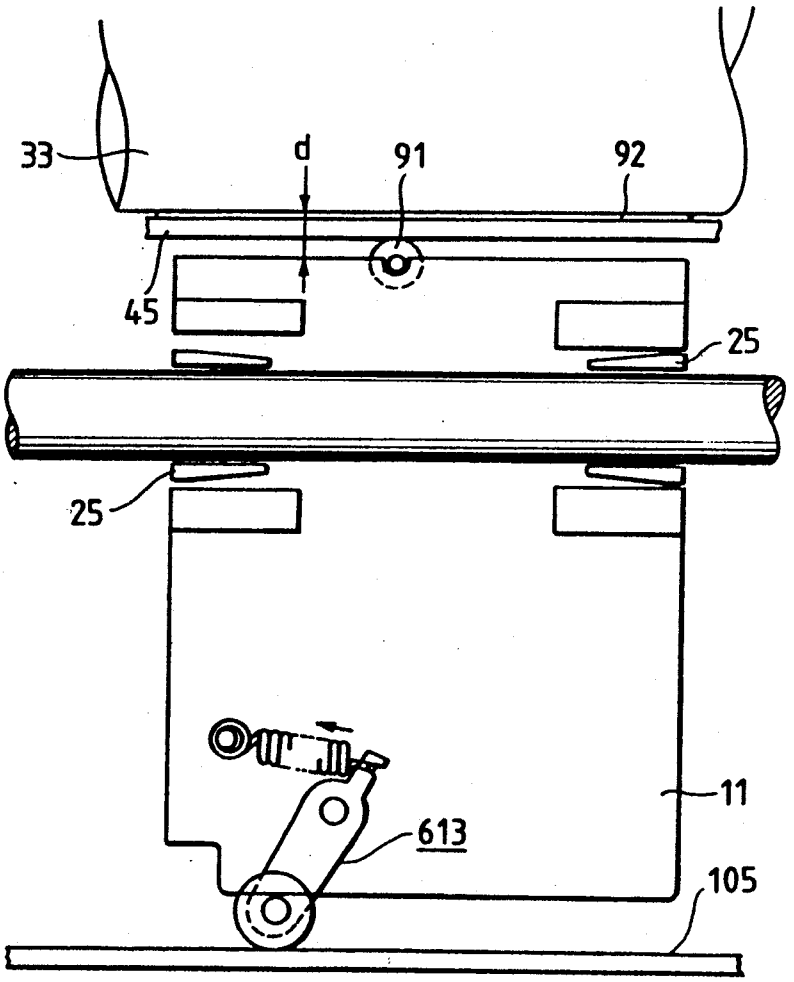
Figure 17:
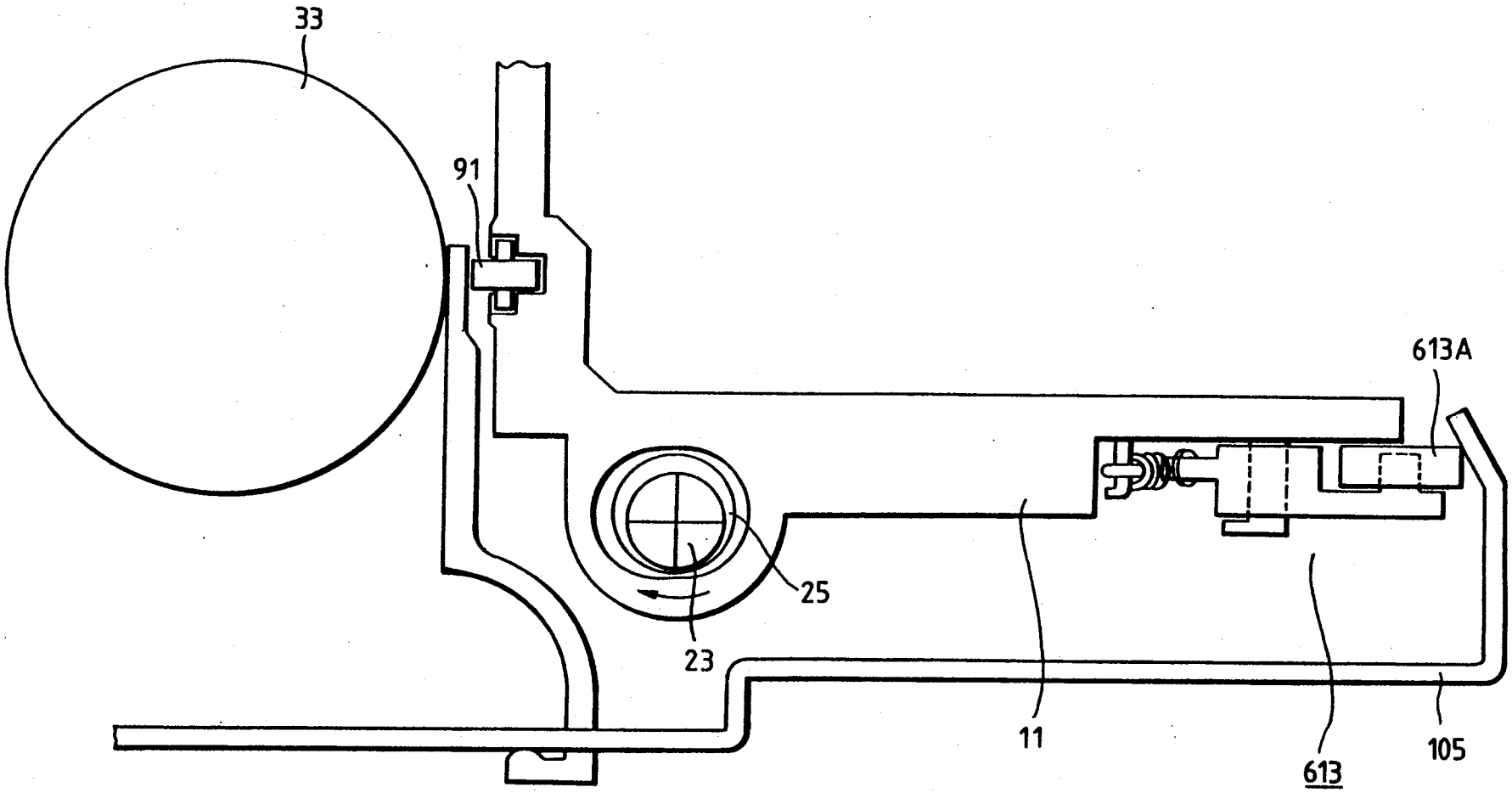
FIG. 17 is a typical side view showing how a guide bearing changes along with changes as indicated above.

Referring now to FIGS. 16 and 17, the automatic adjustment of an interval (thereafter referred to as a gap) between a recording medium and a discharge port face of the head cartridge, based on the construction of a roller 91, a roller spring 613 and bearings 25 will now be described.

The automatic adjustment of the gap can be performed depending on the thickness of a recording medium inserted between a paper presser bar 45 and a platen roller 33. When recording onto a relatively thin, ordinarily used recording medium 92 as shown in FIG. 16A, the left bearing 25 in FIG. 16 is located almost centrally in a long hole. A carriage 11 is forced toward the paper presser bar 45 by a reaction force from a front end plate 105 biased by a roll spring 613, whereby a roller 91 presses the paper presser bar 45. The respective reaction forces against the force with which the roller 91 presses the paper presser bar 45, and the force with which the above mentioned roller spring 613 biases the front end plate may cause moments around the right bearing in FIG. 16, and the position of the bearing 25 in the long hole as indicated above can be determined when two moments are in equilibrium. In other words, a guide shaft 23 fixed to the body of device, and hence the position of the carriage 11 relative to the bearings 25 are determined, so that a gap d between a discharge port of the head cartridge 9 attached thereon and a recording medium can be determined.

FIG. 16B shows a the position of a carriage 11 when recording onto a relatively thick recording medium 93, e.g. an envelope. In this case, a roll 91, and hence the carriage 11 retract downwardly in FIG. 16B, due to the thickness of the recording medium, as compared with those in FIG. 16A. Consequently the reaction force from the front end plate 105 caused by the roll spring 613 changes, so that the equilibrium position of the above moments correspondingly changes. Consequently, a relative position between the bearing 25 on the left side in FIG. 16B and the carriage 11 changes, whereby the carriage 11 has its front end portion open to the left side in FIG. 16, and the gap between the discharge port and the recording medium is almost equal to a gap d in FIG. 16A. In this case, the bearing 25 on the left side changes the position in the long hole by swinging relatively as indicated by arrow in FIG. 17.

It should be noted that a recording medium thicker than ordinary cardboard, for example, can be used with the positional change of the, roller 91, or the paper presser plate 45 can be positioned away by a great amount corresponding to such a cardboard and keep the gap fixed, with the position of the roller 91.

In the above arrangement, a roller spring 613 has a roller 613A pressed downwardly in FIG. 17, as the roller 613A is in direct contact with a bowed oblique portion of a front end plate 105, thereby pressing the entire carriage 11 downwardly. Consequently, the carriage 11 is prevented from lifting up, to make stable the ink discharge direction from the head cartridge 9 attached thereon.

Referring to FIG. 15 again, 111 denotes a cut away portion on the left side lower portion of the carriage 11, to be engaged with a pulley axis 290A near a home position. This engagement is accomplished when the carriage 11 moves to a cap position on the discharge port face, and in this engaged position, the discharge port face is covered with a cap 51 (FIG. 2). With this engagement, even when an oscillation is applied to a recording apparatus, the cap 51 is not detached from the discharge port face of the head cartridge 9 as the carriage 11 can not move in the forward or backward direction, thereby ensuring the capping.

As the pulley axis 290A is also used to engage with the cut away portion 111 of the carriage 11, no particular member is necessary for this engagement, resulting in a simple and cheap construction. Further, the cut away portion 111 is formed with a beveled inlet portion so as to facilitate the engagement with the pulley axis 290. Consequently, the engagement can be easily performed, even when the carriage 11 is displaced depending on the thickness of paper.

Figure 18:
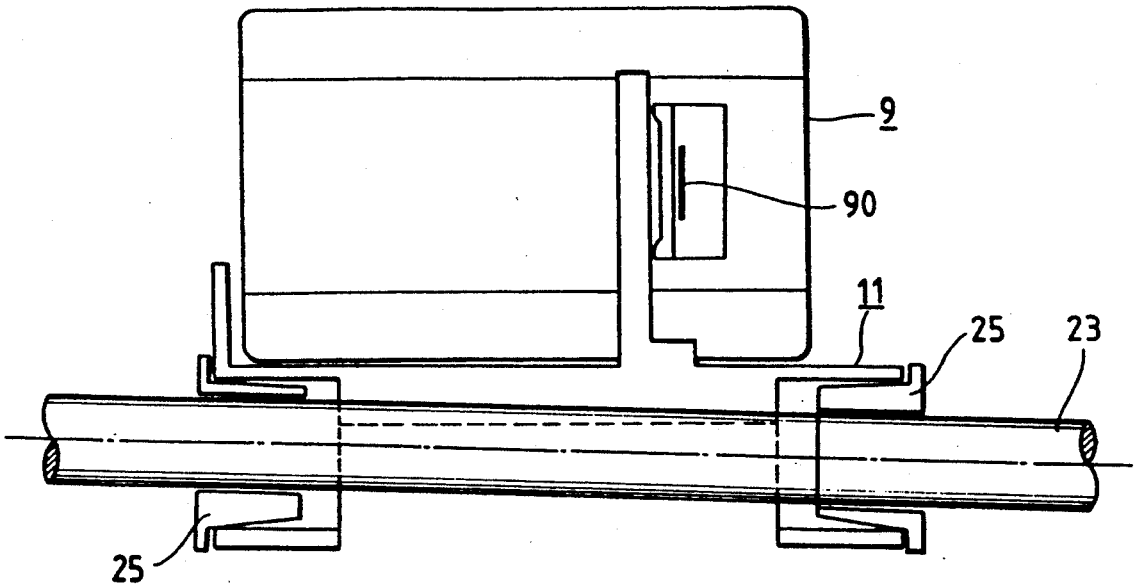
FIG. 18 is a typical front view showing a mechanism for inclining an arrangement of discharge ports with respect to the movement direction of the carriage.

FIG. 18 is a typical elevation view of the head cartridge 9 and the carriage 11 when viewed from a recording medium side. As clearly shown, the carriage 11 and the head cartridge 9 attached thereon are inclined to the guide shaft 23, and hence to the movement direction of the carriage 11, whereby the direction of the discharge port arrangement is also inclined.

This inclination is accomplished by using two bearings 25 whose bearing portions are eccentric as described above. The left bearing 25 (to be right in FIG. 18) is mounted with its eccentric position located downwardly, as seen in FIG. 14 and FIG. 17, while the right bearing 25 (to the left in FIG. 18) is mounted with its eccentric position located upwardly.

Figure 19A:
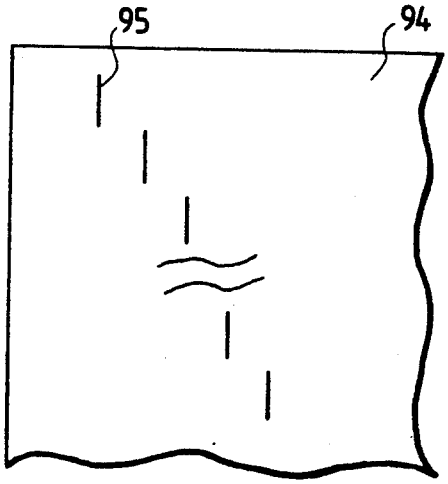
FIG. 19A is a typical plan view showing a recording example without the inclination mechanism.
Figure 19B:
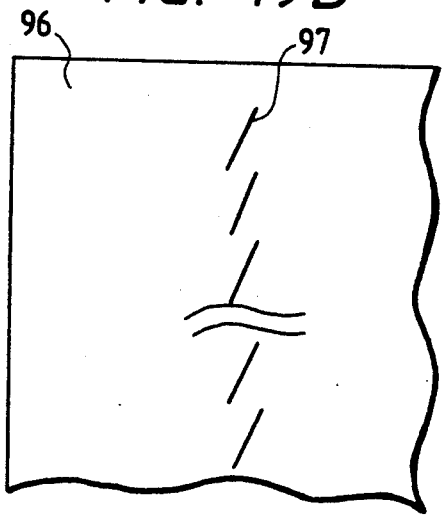
FIG. 19B is a typical plan view showing a recording example with the inclination mechanism.

The construction in which the discharge port arrangement is inclined as shown above is used when a plurality of discharge ports are driven in a time division manner. An ink jet recording head is generally driven in a time division manner based on the viewpoint that the recording speed and the drive power can not be increased. For example, when 64 discharge ports arranged vertically, are divided into 8 blocks to be driven in a time division manner, the recordings 97 are performed on a recording paper 94 as shown in FIG. 19B, during carriage movement, when the discharge port arrangement is not inclined. The recording thus made, is seen as slanting lines when viewed macroscopically. On the contrary, when the discharge port arrangement is inclined as in this embodiment, the recordings 95 are performed don a recording paper 94 as shown in FIG. 19A, and represent vertical lines as macroscopically seen. It should be noted that this inclination is not only effective for time division driving of each block, but also for the time division driving of each discharge port.

As the inclination according to this embodiment is performed by the bearings 25 mounted on both side end portions of the carriage 11, the precision of the inclination is easy to achieve, because the distance between these bearings is relatively long. As it is only needed to mount one type of bearings in opposite vertical directions, the inclination is simply accomplished. Further, when the timing for driving in a time division manner is different, depending on the speed of the carriage, the inclination according to the above mentioned timing can be accomplished by changing only the bearings without changes of being made in the carriage and the recording head, whereby it is possible to make use of a common carriage.

Figure 20A:
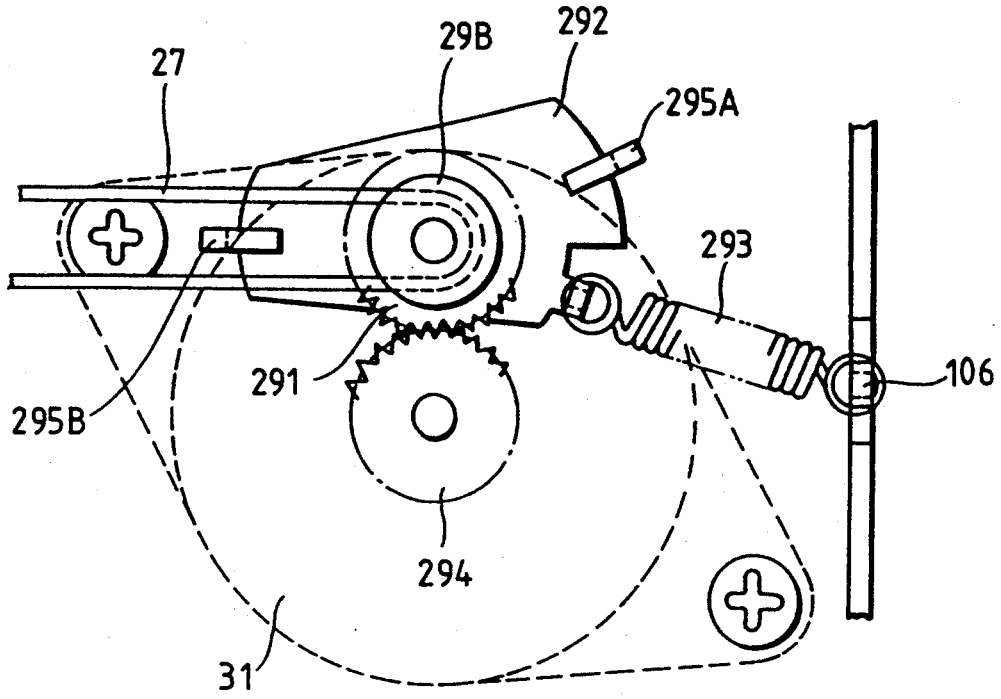
FIG. 20A is an upper view showing a tension mechanism of belt and its drive mechanism for driving a carriage as shown in FIG. 2.
Figure 20B:
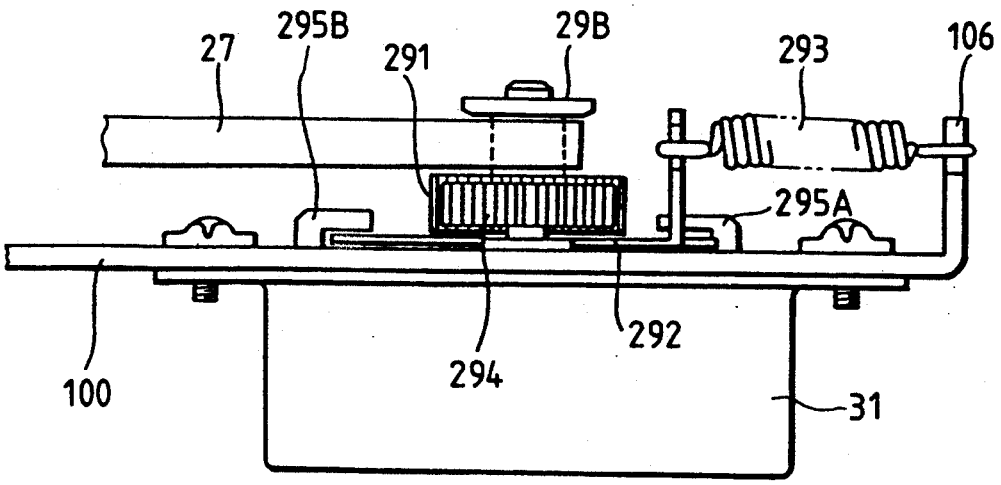
FIG. 20B is a front view showing a tension mechanism of belt and its drive mechanism for driving a carriage as shown in FIG. 2.

FIGS. 20A and 20B are upper and elevation views showing the detail near a pulley 29B disposed on the right end portion of the device, in which two pulleys are used to drive a timing bell for moving the carriage. On the pulley 29B is fixed coaxially a driven gear 291, which mates with a drive gear 294 fixed to the rotation axis of a carriage motor 31. A bracket 292 freely rotatably bears on a shaft to which the pulley 29B and the gear 291 are fixed.

One end of a spring 293 is connected to the bracket 292, while the other end thereof is connected to a projection 106 standing on a bottom plate 100. Consequently the bracket 292 is energized in the direction deviated by a predetermined angle from the direction along which the timing belt 27 extends. Then the bracket 292 (and the gear 291 and the pulley 29B which bear on a axis thereof) moves freely, except that it is restricted in the upper or lower direction and a predetermined direction along the bottom plate 100 by the L-shaped members 295A and 295B standing on the bottom plate 100. Accordingly, with the energizing force by the spring 293, the tension on the timing belt 27 and the mating force between the gear 291 and the gear 274 can be obtained according to the brach force.

Figure 21:
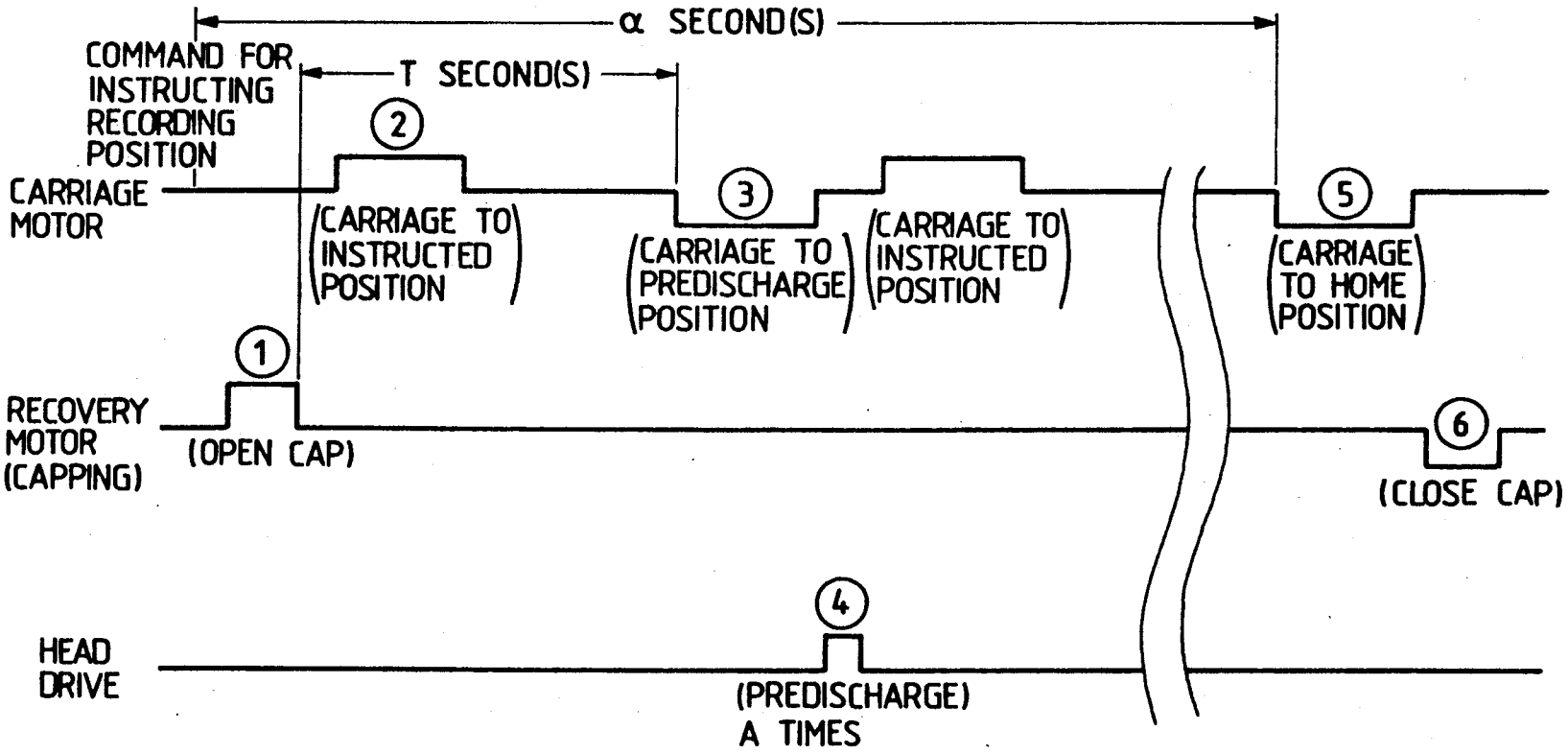
FIG. 21 is a timing chart in a recording position instruction mode for a recording apparatus according to an embodiment of this invention, FIG. 22 having parts
Figures 22, 22A:
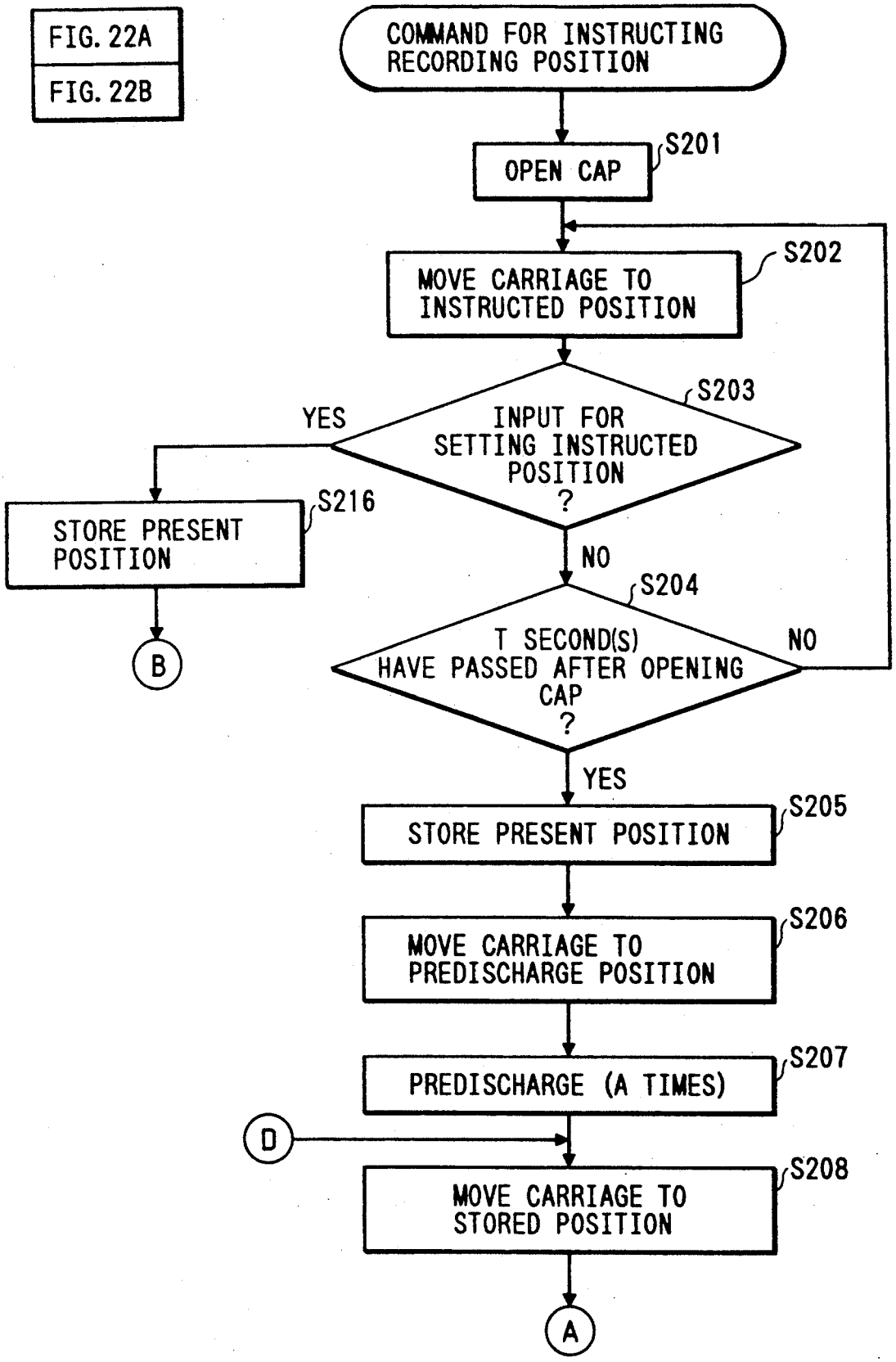
FIG. 22A and FIG. 22B, is a flowchart in a recording position instruction mode for a recording apparatus according to an embodiment of this invention.
Figure 22B:
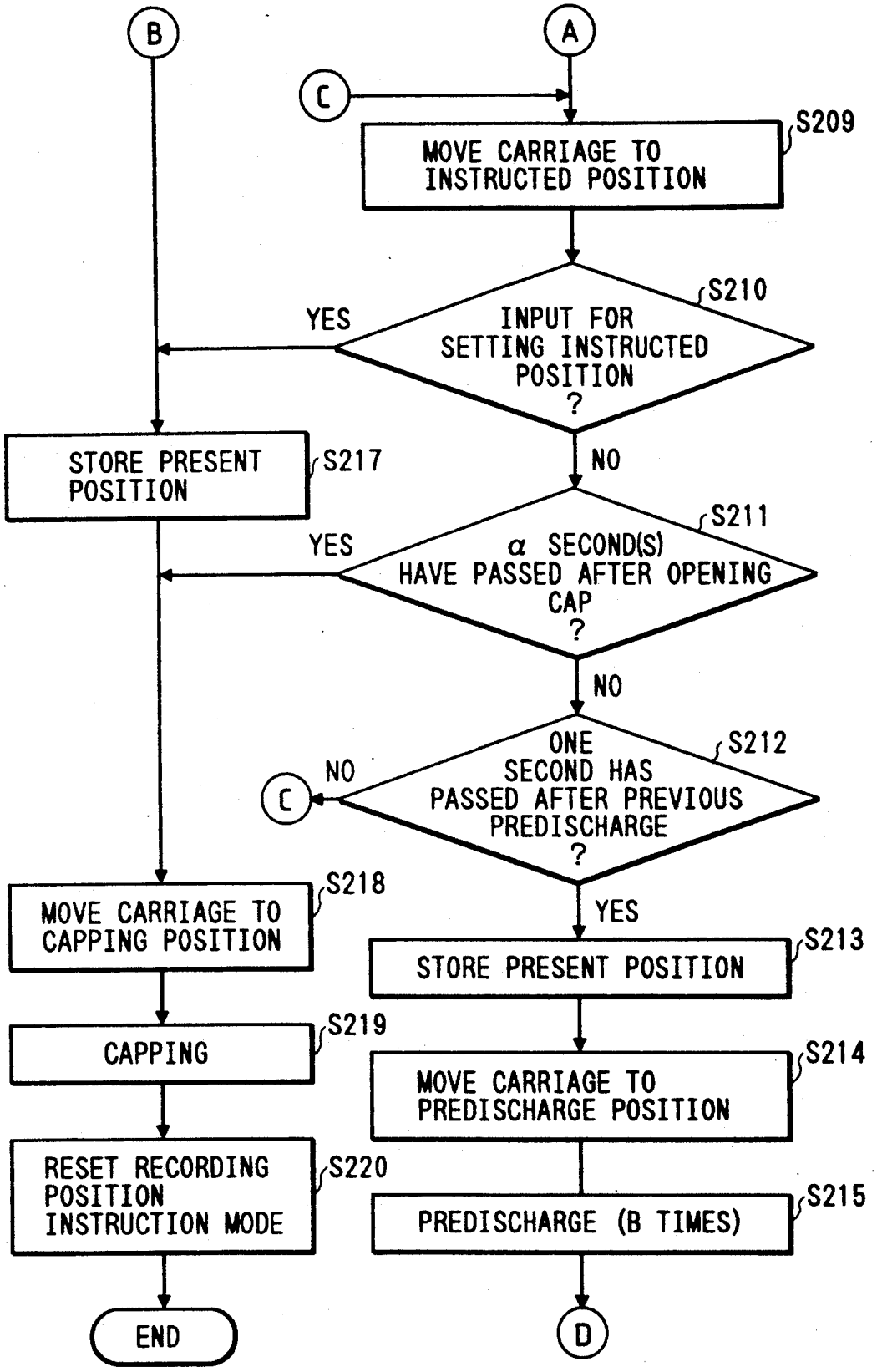

FIGS. 21 and 22 are a timing chart and a flow chart respectively, for showing the control procedure in the recording position instructed mode for an ink jet recording apparatus according to this embodiment. The recording position instructed mode in accordance with this embodiment is a control procedure that is activated when recording onto a formatted paper or a recording paper already once thereon such as in an electronic typewriter in which a recording apparatus in accordance with this embodiment is used. The recording position and range are set and confirmed while moving the carriage (recording head), during which no ink droplet is discharged. Therefore, in order to prevent the ink from being thick or not discharging, it is necessary to conduct predischarge and the capping, of the recording head in which it is required to move the carriage to a position for the predischarge for a predetermined time, by interrupting the processing such as the setting of a recording position with the carriage.

Referring now to a timing chart of FIG. 21 as well as a flow chart of FIG. 22, the control procedure in the recording position instructed mode will be described. If a command for instructing recording position is a predetermined key input, this control procedure is then activated, when the appropriate key is depressed a cap 51 is opened at step S201 (in FIG. 21, only the timing is noted thereafter), and at step S202, the carriage 11 is moved toward an instructed position, for example, by the input of space key (timing 2). Meanwhile, at step S203, a determination is made whether there has been a predetermined key input for setting the instructed position, resulting in the carriage 11 reaching the instructed position, and if not, at S204, another determination is made whether a predetermined time, T seconds, have passed since the, opening of the cap. If T seconds have passed, the current position of the carriage 11 is stored at S205, and the carriage 11 is moved to a predischarge position at S206 (timing 3). Further, a predetermined amount of ink is predischarged (A times) at S207 (timing 4). Then at step S208, the carriage 11 is returned to the previously stored position, and at step S209, it is moved to the instructed position as above described. Meanwhile, at step S210, a determination is made whether there has been a predetermined key input for setting, instructed position in the same way as described above, and if not, another determination is made whether a predetermined time, $\alpha$ seconds has passed since the command for instructing the setting of the instructed position was issued, or whether this control procedure was started, at step S211. This $\alpha$ seconds was set because the setting of the instructed position will be normally terminated during this time, and because if the recording head is kept open without the cap beyond that period, it will cause a significant damage to the discharging or ink droplets.

If a negative determination is made at step S211, another determination is made at step S212 whether a predetermined time, t seconds, has passed since the previous predischarge, and if so, the processing proceeds to steps S213 and S214 which are the same as those described above, then predischarge occur B times at step S215, and the procedure returns to step S208.

If it is determined that a predetermined key input for setting instructed position has occurred at step S203 or S210, the position is stored at step S216 or S217, and if a determination is made that $\alpha$ seconds have passed at step S211, the processing proceeds to step S218. At step S218, the carriage 11 is moved to the capping position (timing 5), and is capped at step S219 (timing 6), the instruction mode is reset at step S220, and the processing terminates.

If should be noted that the elapsed times T, t and $\alpha$ seconds as above indicated can be set depending on the temperature or humidity in the atmosphere, or may be automatically set based on the detection by a sensor, e.g., a thermal sensor.

The movement to the instructed position using the control procedure as shown above can be performed while a user keeps the space key down, in which the position of the carriage 11 relative to a recording medium, or the position of the discharge port can be known, by using both a marker 49 on the carriage 11 and a scale 47 on the paper presser bar 45, as shown in FIG. 2 and FIG. 15. It should be noted that the position of the marker 49 is offset from that of the discharge port, and that this offset amount is prestored, and automatically corrected i the recording operations. Because the scale 47 is provided on a particular member of the ink jet recording apparatus, such as a paper presser bar 45, the adjustment of the recording medium can be performed in significant proximity of the scale.

In operations such as the movement to the instructed position, the amount of movement of the carriage 11 can be known by using a marker on the lever as shown in FIG. 2 and FIG. 15, and a scale (not shown) indicated on a window on a cover of the device as shown in FIG. 1.

In this way, the using of the markers 49, 17 and other scales is especially effective in returning the carriage to the interrupted position again, when the position confirming operation with the movement of carriage is interrupted due to the predischarge in an ink jet recording apparatus.

Figure 23:
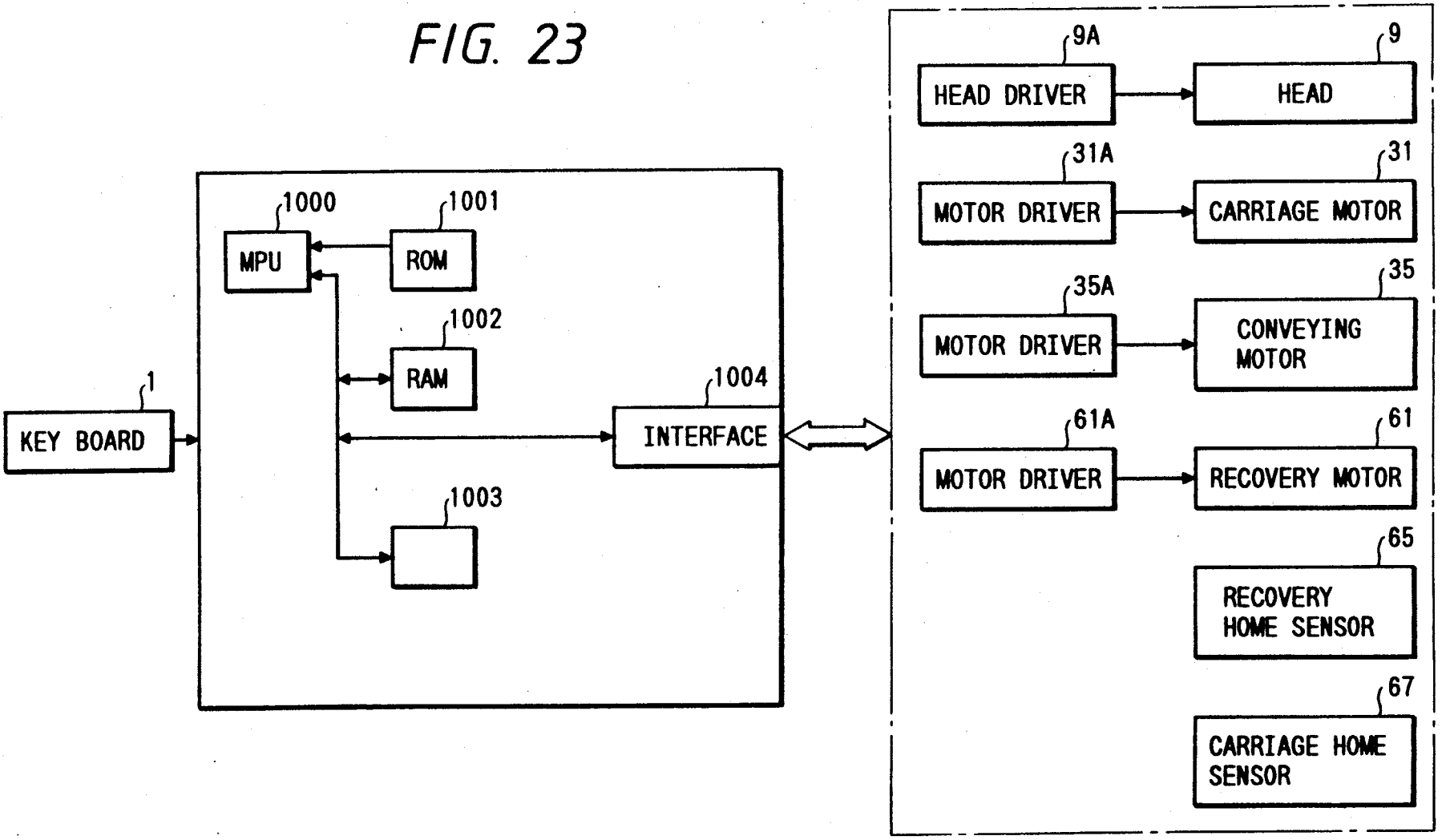
FIG. 23 is a block diagram showing a control configuration of the above indicated mode.

FIG. 23 is a block diagram showing a control configuration for performing the controls as shown in FIG. 21 and FIG. 22. A capping position and a movement position of the carriage 11 can be known based on the detection with a recovery home sensor 65 and a carriage home sensor 67. The movement to the instructed position and the input for setting instructed position can be performed with a space key and other predefined keys on a keyboard 1. In FIG. 23, 1000 denotes a MPU for executing the control procedure as above indicated, 1001 denotes a ROM for storing the control procedure as indicated, above and 1002 denotes a RAM for storing a current position of the carriage 11, or storing for a work area in the above mentioned control execution. An 1003 denotes a timer for measuring the time, such as T seconds, t seconds or $\alpha$ seconds.

Figure 24:
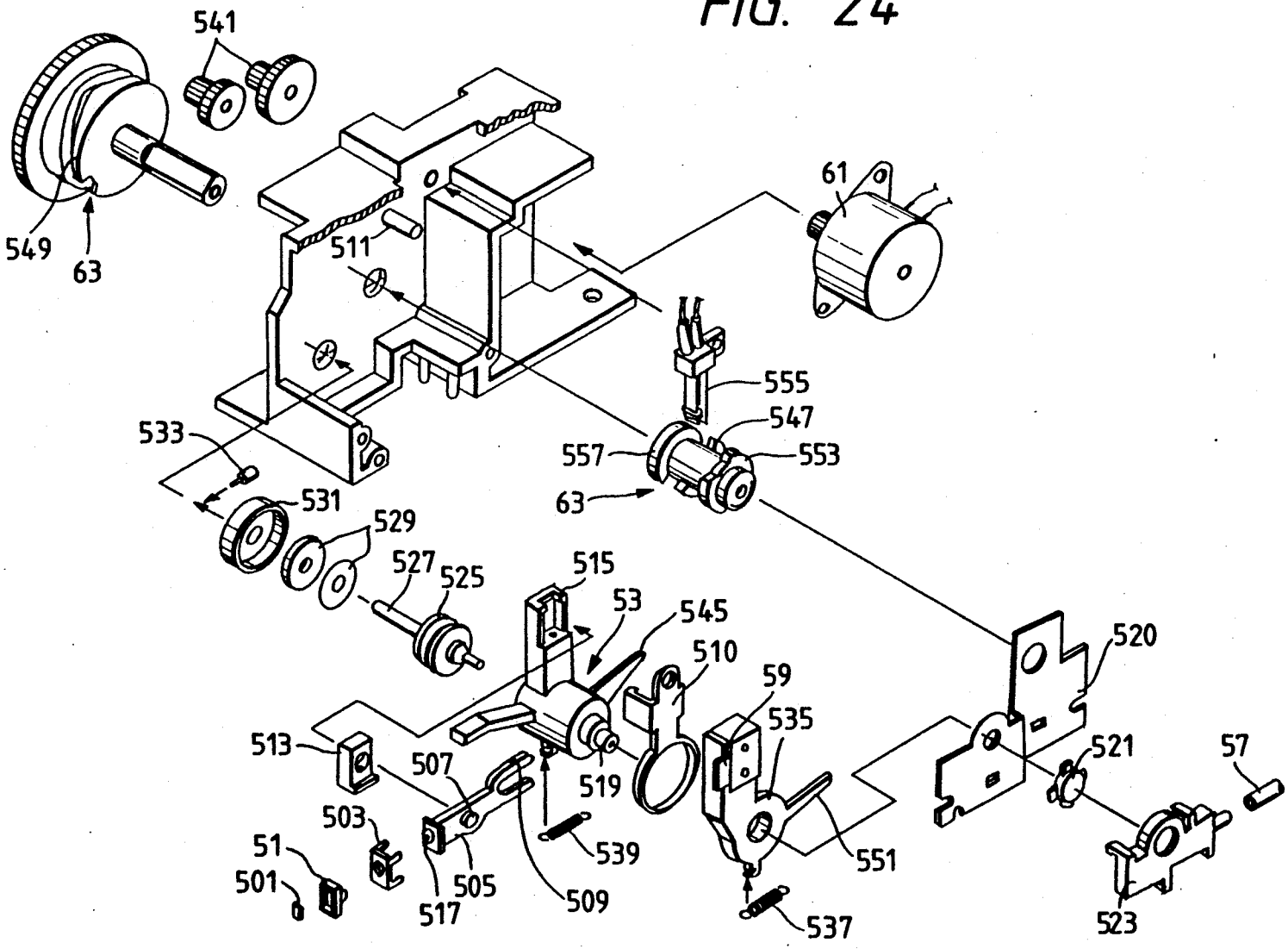
FIG. 24 is an exploded perspective view of a suction recovery mechanism as shown in FIG. 2.

FIG. 24 is an exploded perspective view showing a main portion of the recovery device comprising a cap 51, a pump 53, a blade 59, a motor 61 and a cam mechanism 63. 501 denotes an ink absorbing member disposed in the inside of the cap 51, 503 denotes a holding member for holding the cap 51, and 505 denotes a cap lever rotatably attached around a pin 507, for bringing the cap 51 into direct contact with or separating it from a discharge port formation face of the discharge unit 9*a* by the force applied to the pin 507. 511 denotes a pin for regulating a range of rotation for the cap lever 505, engaged with an end portion 509 of the cap lever 505. 513 denotes a jig having a hole, into which the pin 507 of the cap lever 505 is fitted, which is used to attach the cap lever 505 onto a support 515 on the pump 53. 516 denotes a stop member for securing the attached state. 517 denotes a working section for exerting the force for bringing the cap 51 into direct contact with the discharge port formation face, which is engaged almost centrally in a back side portion of the cap 51. The working section is provided with an exhaust port 517A for sucked ink, and ink flow paths are formed inside the cap lever 505, the pin 507, the jig 513, and the support 515. If the pump 53 exerts the suction force, the ink is passed through these flow paths into the pump 53 as shown by arrow in FIG. 24.

519 denotes a shaft projecting from a center of end face of the pump 53 and internally formed with an ink flow path, and is rotatably attached on the side wall 520. The rotation force of the pump 53 is applied via the support 515 onto the cap lever 505, whereby the cap 51 moves outward or inward. 521 is a flow path formation member connected to the pump shaft 519, and 523 is an attachment member for a tube 57. The ink flow path is formed in the inside of the shaft 519, the flow path formation member 521 and the attachment member 523, in which the ink sucked by the pump 53 is introduced through those flow paths via the tube 57 into a waste ink tank 55, as indicated by an arrow in FIG. 24.

525 denotes a piston for the pump 53, 527 denotes a piston shaft, 529 denotes a packing, and 532 is a cap of the pump 53. 533 denotes a pin attached to the piston shaft 527 and for receiving the transmitted force activating the piston 525. 535 denotes a blade lever to which a blade 59 is attached, rotatably supported around an axis projecting from the end face of the pump 53, and it projects or retracts the blade 59 toward or from the recording head side, along with the rotation. 537 denotes a spring for affording a rotational force to the blade lever 535 in the direction of projecting the blade 59. And 539 denotes a spring for affording a tendency to rotate the pump 3 itself in the direction in which the cap 51 moves toward the recording head.

541 denotes a gear train for transmitting the rotation of the motor 61 to the cam mechanism 63, which comprises a cam 547 for engaging and rotating an engaging portion 545 on the pump 53, a cam 549 for engaging a pin 533 on the piston shaft 527 of the pump 53 and activating the pump, a cam 553 for engaging and rotating an engaging portion 551 on the blade lever 535, and a cam 557 for engaging a switch 555 detecting a home position of the cam mechanism 63. The operations of those cams will be described later.

Now one embodiment of a cap 51 as shown in FIGS. 25A~25H will be described.

A portion opposed to a recording head discharge port inside the cap is provided with an ink absorbing member 501 by two ribs 568, which is constructed not to entirely cover an ink suction port 561 provided in a vertically lower portion of the cap face the, but to cover about more than half area of the ink inlet port 561. As the ink absorbing member 501 has its upper end side contact the upper end face 566 inside the cap 51, as well as the cap face 565, the positioning of the ink absorbing member 501 is easy. A lower end face 567 inside the cap 51 is slightly upwardly inclined toward the ink suction port 561, facilitating the suction and removal of ink droplets. An ink flow path 563 connects the ink suction port 561 with an ink exhaust port 517A, and is provided obliquely upwardly from the ink suction port 561 toward, the ink exhaust port 517A. The opening area of the ink flow path of the suction port 561 has a larger cross-sectional area than that of the ink exhaust port 517A.

If the ink absorbing member 501 is constructed to contact the lower end face 567 inside the cap 51, the ink impregnated in the ink absorbing member might often pass through the lower end face 567 to form droplets and stick to a discharge port face. However, as in this embodiment, if the ink absorbing member 501 is constructed to uncover a lower portion of the ink suction port 561, the ink is impregnated and held in a vertical lower portion of the ink absorbing member 501. Thus, the ink is removed from inside the cap with the suction force of the ink suction means, through the ink suction port 561 which is open to the vertical lower portion inside the cap 51 and the vertical lower portion of the ink absorbing member 501.

As in this embodiment, when an ink jet recording apparatus is an electronic typewriter capable of operating in a typewriter mode and a word processor mode, particularly, when it takes a lot of data processing time to print ornamental characters and graphics in the word processor mode, the ink absorbing member 501 within the cap is exposed to the atmosphere. In such a case, though the ink absorbing member 501 may be dry and stiffened due to the evaporation of water or alcohol from the ink, the lower portion of the ink suction port 561 is not covered with the ink absorbing member, but is placed in an open state, thereby maintaining the suction force of ink within the cap for the next predischarge operation. The ink absorbing member 501 is moistened with the ink predischarged at that time, so that its ink absorbing capability can be recovered again.

Further, if a long recording is performed, the amount of ink exceeding the absorbing capacity of the ink absorbing member 501 may be occasionally discharge during the predischarge during that recording period. In such a case, as in this embodiment, if the ink absorbing member 501 is constructed to cover about more than half of an opening area of the ink suction port 561, the ink impregnated and held in the lower portion of the ink absorbing member 501 by the force of gravity is sucked by the ink suction means, and at the same time, the dropped ink is sucked through the ink suction port 561 open to the lower portion inside the cap, so that an effective suction and removal of ink can be accomplished.

In the preferred embodiment, the ink suction port 561 has a shape of an elongated oval or continuously curved surface having a longitudinal length of 2.25 mm and a transverse length of 1 mm. The ink absorbing member 501 covers the ink suction port 561 at the upper part of 1.25 mm.

Figure 25C:
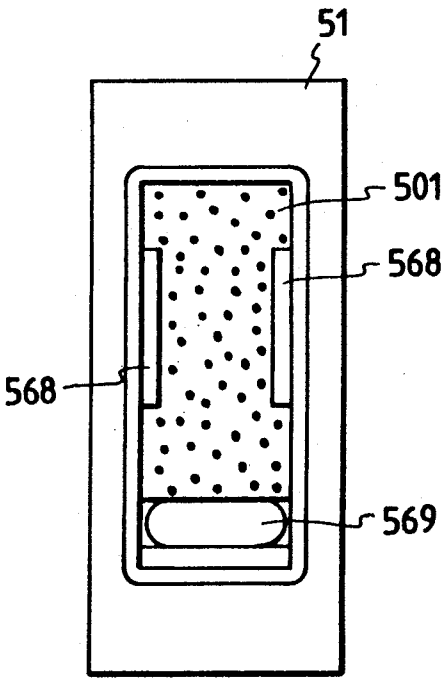
FIG. 25C is a front view of a cap portion on a suction recovery mechanism according to another embodiment of this invention.

FIG. 25C shows another embodiment of a cap 51.

As an ink suction port 569 has an opening portion of at least almost the same width as that of a lower end face 567 (width of the ink absorbing member 501) inside the cap, and thus a more effective suction and removal of ink within the cap can be accomplished.

Figure 25B:
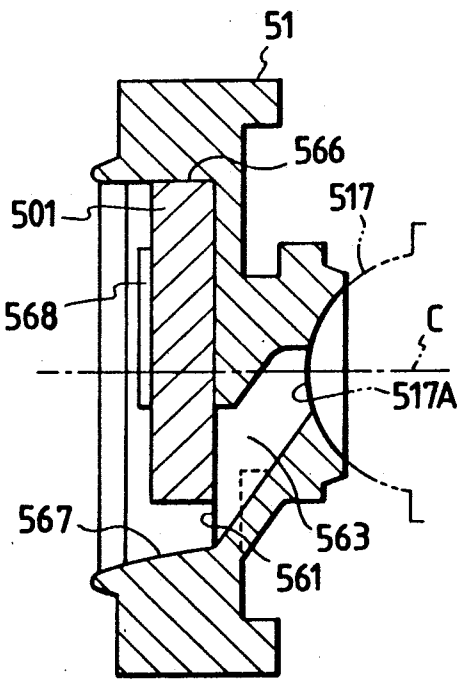
FIG. 25B is a cross-sectional side view taken along a line M—M in FIG. 25A.
Figure 25A:
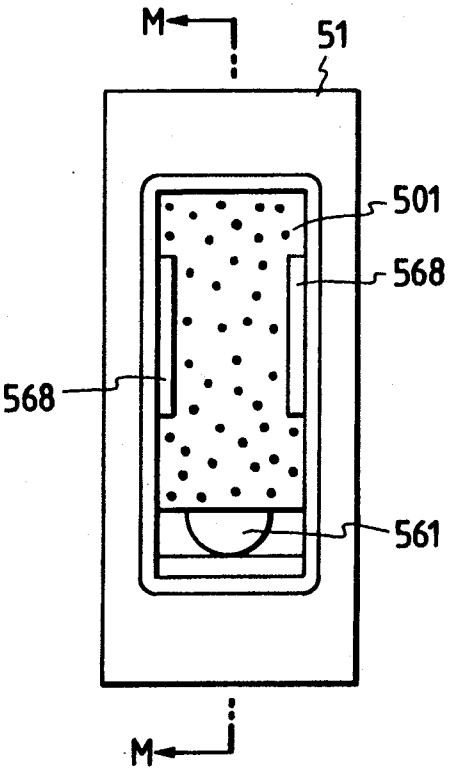
FIG. 25A is a front view of a cap portion on the suction recovery mechanism according to an embodiment of this invention.
Figure 25F:
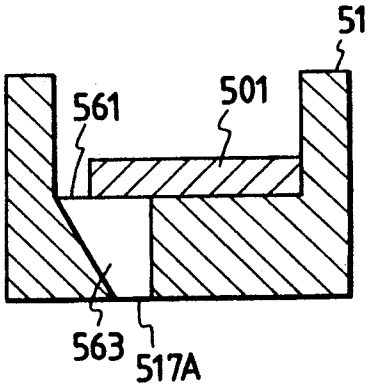
FIG. 25F is a typical cross-sectional side view of a cap portion on the suction recovery mechanism according to another embodiment of this invention.
Figure 25E:
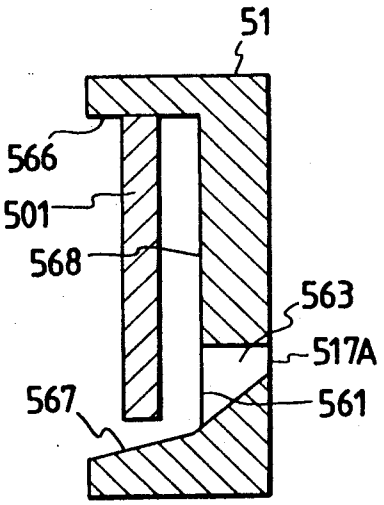
FIG. 25E is a typical cross-sectional side view of a cap portion on the suction recovery mechanism according to another embodiment of this invention.
Figure 25D:
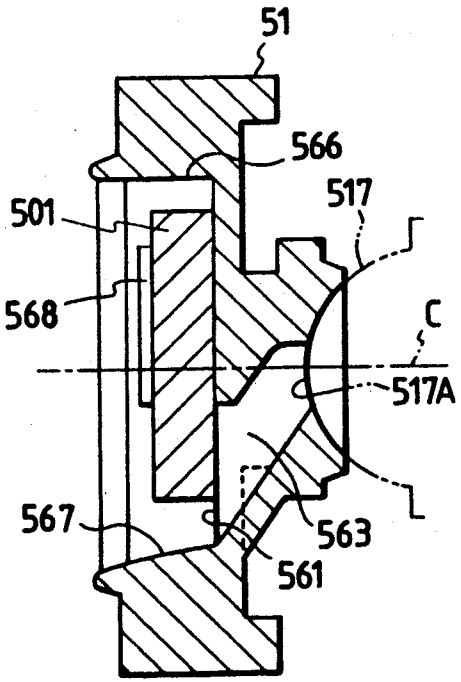
FIG. 25D is a front view of a cap portion on the suction recovery mechanism according to another embodiment of this invention.

FIG. 25D is a cross-sectional side view of a cap 51 according to another embodiment of this invention. This embodiment is similar to that shown in FIGS. 25B and 25C, except that the upper end portion of an ink absorbing member 501 is not in contact with an upper end face 566 inside the cap 51. The ink absorbing member 501 is provided in a position opposed to an ink discharge port, and the same effect as in the previous embodiments was obtained.

FIG. 25E is a typical cross-sectional side view of a cap 51 according to another embodiment of this invention. An ink absorbing member 501 is separated from a face 568 opposed to an ink discharge port of the cap 51. Except for that portion, this embodiment is similar to those of FIGS. 25B and 25C. The ink absorbing member 501 may be attached to an upper end face 566 on an interior side of the cap 51, or attached to a recess or through hole formed on the corresponding portion of the upper end face 566, so that the same effect as previous embodiments can be obtained.

Figure 25H:
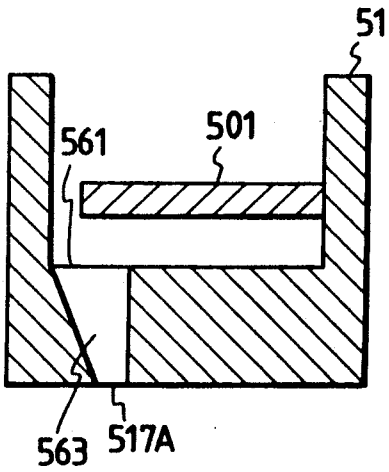
FIG. 25H is a typical cross-sectional side view of a cap portion on the suction recovery mechanism according to another embodiment of this invention.
Figure 25G:
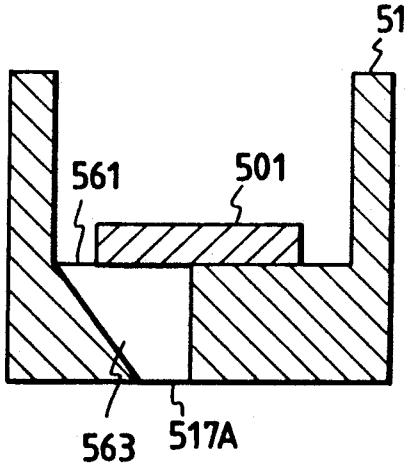
FIG. 25G is a typical cross-sectional side view of a cap portion on the suction recovery mechanism according to another embodiment of this invention.

FIGS. 25F to 25H are typical cross-section side views according to another embodiment of this invention. FIG. 25F, FIG. 25G and FIG. 25H are views rotated clockwise by 90 degrees from FIG. 25B, FIG. 25D and FIG. 25H, respectively. The ink absorbed into an ink absorbing member 501 is sucked and exhausted from a portion of the ink suction port 561 covered with the ink absorbing member 501 through an ink flow path 563 out of an ink exhaust port 517A. Further, the ink suction port 561 as shown in FIGS. 25F to 25H can be replaced with an ink suction port 569 as shon in FIG. 25C, so that the ink within a cap 51 can be more effectively sucked and exhausted, and the suction force of the ink absorbing member 501 can be maintained.

As an ink flow path is provided with a cap lever 505 in this embodiment, the flow path 563 within a cap 51 is constructed as shown in FIG. 25B, but if an ink suction path is provided on another portion, the ink flow path within the cap is not necessarily constructed as shown in FIG. 25B. In other words, if the ink suction port 561 is provided in a vertical lower portion of the cap 51, the ink flow path can be constructed as desired.

Figure 26:
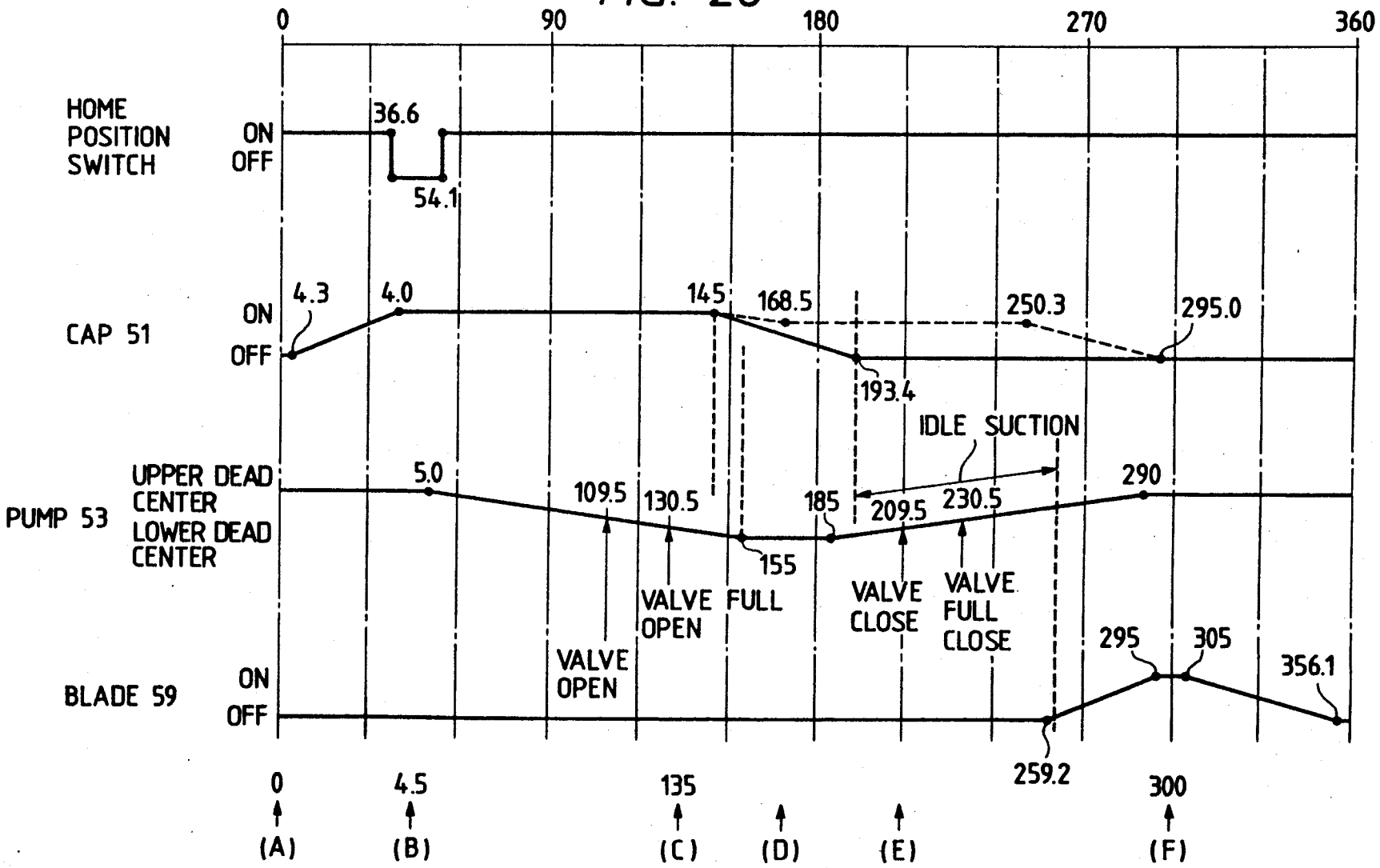
FIG. 26 is a timing chart showing a series of recovery operations on the suction recovery mechanism.
Figure 27:
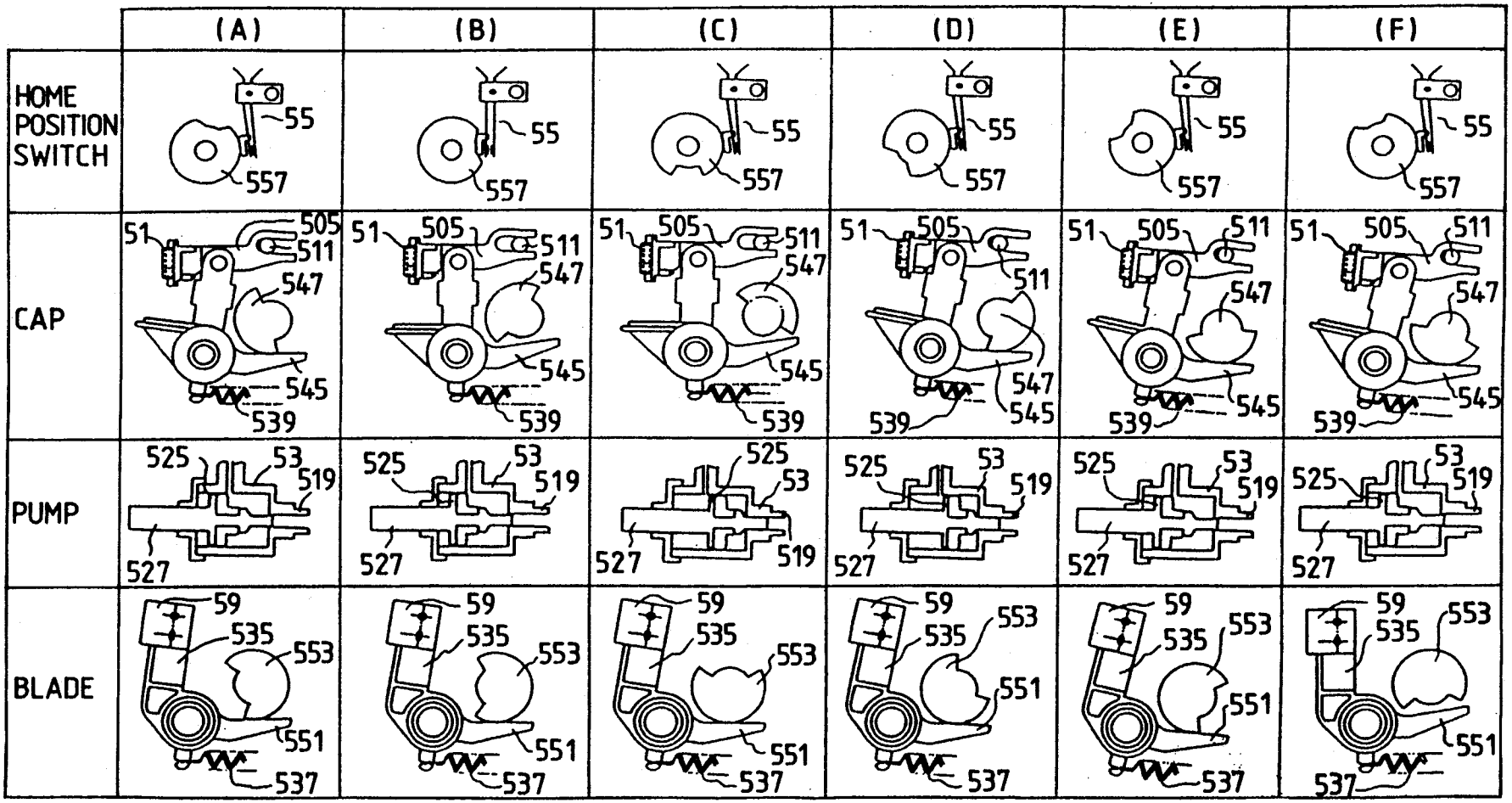
FIG. 27 is a view showing, in time-series, the state of each section in the suction recovery operations on the suction recovery mechanism.

FIGS. 26 and 27 are views for explaining a profile curve of each cam in a cam mechanism 63, and an operation position of each portion corresponding to each cam position, respectively. Note that numerals shown in FIG. 26 are rotation angles of a cam.

In FIGS. 26 and 27, (A) shows the cam position and the state of each portion at the recording operation, in which a cap 51 and a blade 59 are isolated from a discharge port formation face of the recording head, and a pump 53 is placed at an upper dead center position. (B) is a position at which a home position switch 55 is turned off, which is defined to be a home position of the cam mechanism 63. This position is set, for example, while waiting for recording, where the cap 51 covers the discharge port formation face, the blade 59 is retracted, and the pump 53 is at an upper dead center.

If the cam is rotated from the position (B), a piston 525 moves toward a lower dead center position with the cap 51 joined to the discharge port formation face (cap on), thereby increasing a negative pressure of the suction system leading to the cap. Finally, the piston 525 arrives at an ink exhaust port of the pump, after a period of closing the pump (while a valve is closed), the valve begins to open (a point of 109.5 degrees), and completely opens (a point of 130.5 degrees), and the piston reaches to a point (C) near the lower dead center position. Taking into consideration the flow resistance of the ink suction system, after a sufficient suction by stopping the rotation of the cam for a predetermined time, if the cam is rotated again, the piston 525 reaches to the lower dead center position, and the cap 51 begins to separate from the discharge port formation face. This position (D) is held for a predetermined time.

After that, if the cam is further rotated, the piston begins to move toward the upper dead center position again. In this process, the valve begins to close (a point of 209.5 degrees), reaching to a point at which it is completely closed, while the cap 51 is completely isolated from the discharge port formation face at a position (E). By driving the piston 525 several times near this position, the ink remaining in the ink suction system will be sucked into the pump side (idle suction). Left and right spaces of the piston 525 within the pump is communicated through a flow path not shown, which is closed when the piston moves from the upper dead center position to the lower dead center position, and opens when it moves from the lower dead center position to the upper dead center position. The space on the right hand of the piston communicates to a flow path on the pump axis 519. Accordingly, when the piston 525 moves from the lower dead center position to the upper dead center position in the idle suction, the ink introduced into the left space of the piston is transferred into the right space, and when it moves from the upper dead center position to the lower dead center position, the ink is introduced from the ink suction system into the left space, while it is exhausted from the right space to a waste ink tank.

After that, if the cam is further rotated in the positive direction, a blade 59 projects to be in a wiping state (position (F)). If the carriage 11 is moved to the recording area side in this state, the blade 11 engages with the discharge port formation of the head, wiping that surface to remove the ink deposited on the discharge port formation face. And the cam is further rotated to retract the blade 55, so that the cam is set at the position (A). In this state, the carriage 11 is moved to the cap side, so that the discharge port formation face of the head is opposed to the cap 51, and then the cam is moved to the position (B) to cap the head on, and is stopped.

When it is required to transfer to the recording, the cam is rotated in the positive or negative direction from the position (B), to project the blade 59, and then the recording can be performed after wiping with the blade 59.

Figure 28:
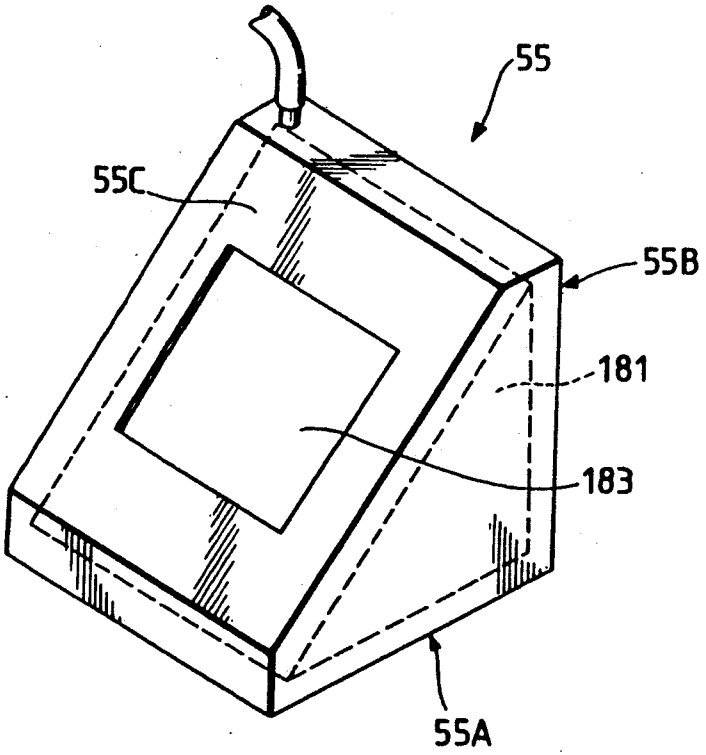
FIG. 28 is a typical perspective view of a waste ink tank for reserving ink discharged by the recovery operation.

FIG. 28 shows an example of a waste ink tank 55 according to this embodiment, in a state when a device is used. 181 denotes an ink absorbing member for holding waste ink, 55A an element used as a bottom portion when the device is used (the state in FIG. 1A), while 55B denotes an element used as a bottom portion when the device is transported with a grip 6, housed as shown in FIG. 1B. 55C denotes an inclined surface which is never placed in the vertical downward direction, and in this embodiment, provided with a gas permeable cloth 183 thereon. This gas permeable cloth 183 passes the ink solvent vapor, but does not permeate the ink liquid, and more particularly, for example, a paper load (Teijin Limited) may be used.

Figure 29A:
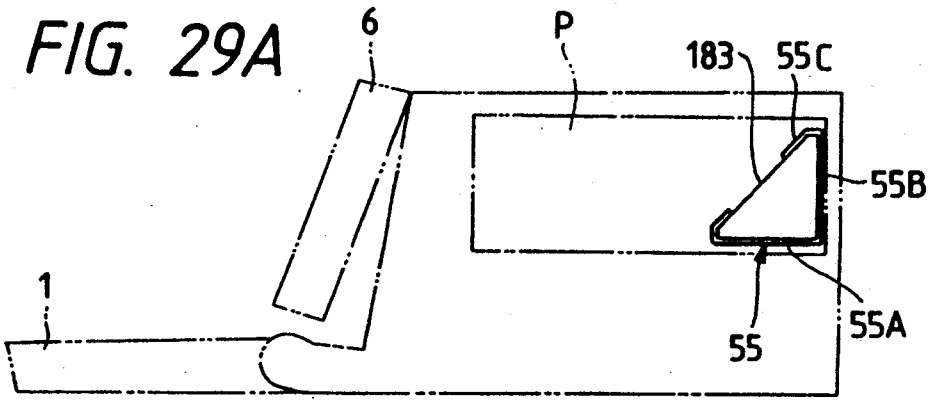
FIG. 29A is a view showing an arrangement of the waste ink tank when a printer is used.
Figure 29B:
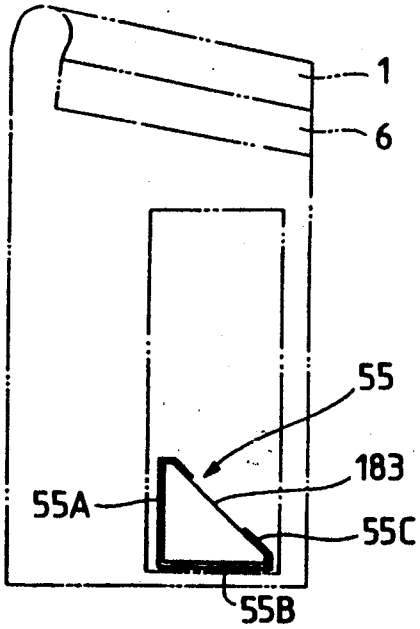
FIG. 29B is a view showing an arrangement of the waste ink tank when a printer is stored.

With the disposition of such a gas permeable cloth 183, the ink does not leak almost entirely from the waste ink tank 55, but in this embodiment, by providing the gas permeable cloth 183 on the inclined surface, the leak can be completely prevented. This is because as shown in FIGS. 29A and 29B, when the device is used (FIG. 29A), a portion 55A is a bottom face, while an inclined surface 55C is directed upwardly, but when it is housed (or transported) (FIG. 29B), a portion 55B is a bottom face, while the inclined surface is also directed upwardly. Thus, the waste ink can neither soak through the gas permeable cloth 183, nor leak through it. Note that P denotes a printer in FIG. 29A.

This invention has an excellent effect on a recording apparatus having a recording head with an ink jet recording method, especially a bubble jet recording method. With such a method, the higher density and definition of recording can be accomplished.

The typical construction and principle is preferably based on a basic principle as disclosed in U.S. Pat. No. 4,723,129 and No. 4,740,796 specifications. This method is applicable to both a so-called on-demand type and a continuance type, and particularly the on-demand type is more effective because the heat energy is generated on an electricity to heat conversion body by applying at least one drive signal causing a rapid rise of temperature exceeding that of nucleate boiling corresponding to recording data, to a sheet in which the liquid (ink) is carried, and the electricity to heat conversion body disposed corresponding to a liquid path, causing the film boiling on the heat acting surface of the recording head, so that a bubble in the liquid (ink) can to formed corresponding one-to-one to that drive signal. With the growth and contraction of this bubble, the liquid (ink) is discharged via a discharge port to form at least one droplet. If this drive signal is pulse-shaped, the growth or contraction of bubble is performed immediately and appropriately, and thus, the discharge of liquid (ink) is more preferably accomplished with the especially good response characteristic. The appropriate pulse-shaped drive signal is described in U.S. Pat. No. 4,463,3594 and U.S. Pat. No. 4,345,262. If the conditions as described in U.S. Pat. No. 4,313,124 which is an invention relating to the temperature-rise rate on the above mentioned heat acting surface are adopted, more excellent recording can be performed.

The construction of a recording head includes that as described in U.S. Pat. No. 4,558,333 and U.S. Pat. No. 4,459,600 which disclose a construction in which the heat acting portion is disposed in a bowed area, in addition to the combination of a discharge port, a liquid path and an electricity to heat conversion body (a straight liquid path or right angle liquid path). In addition, this invention is also effective with a construction based on Japanese Patent Laid-Open No. 59-123670 which discloses the use of a common slit as a discharge portion for a plurality of electricity to heat conversion bodies, and Japanese Patent Laid-open No. 59-138461 which discloses a construction in which an aperture absorbing the pressure wave of heat energy corresponds to a discharge portion. The construction according to this invention enables the reliable and efficient recording in whatever form a recording head may be made.

Further, this invention is also effective for a full-line type recording head having a length that corresponds to that maximum recording length of a recording apparatus. Such a recording head is constructed in either a combination of a plurality of recording heads to fill that length, or one integrally formed recording head. In addition, this invention is also effective in using a replaceable chip type recording head which enables an electrical connection to an apparatus body and the supply of ink from the apparatus body, or a cartridge type recording head integrally formed on the recording head, because a serial type recording head as indicated in the above example can be also mounted onto the apparatus body.

It is preferable to add recovery means for a recording head or preliminary auxiliary means provided as a construction of a recording apparatus according to this invention, as it makes the effect of this invention more stable. More specifically, it includes capping means for a recording head, cleaning means, pressing or suction means, and preliminary heating means consisting of an electricity to heat conversion body or other heating elements or a combination of both, and a predischarge mode for discharging apart from recording is effective to make the stable recording.

A recording head to be attached may be either of a single-head type corresponding to a mono color, or multiple-head type corresponding to a plurality of inks differing in recording color or density.

Further, an ink jet recording apparatus according to this invention is used for an image output terminal in an information processing equipment such as a computer, a copying machine in combination with a reader, or a facsimile terminal equipment having the transmission and reception feature.

As described in detail, according to this invention, when an ink absorbing member is dry and stiffened due to the evaporation of water or alcohol from the ink during recording of a long duration, as it is exposed to the atmosphere, the suction force of ink within a cap can be maintained.

According to this invention, even if a quantity of ink is discharged within a cap in a recording of a long durating duration the ink can be sucked and removed effectively, owing to a large number predischarging operations.

I claim:

1. A suction recovery device for recovering ink from a recording head having a face having a discharge port for discharging ink onto a recording medium, said suction recovery device comprising:

a cap for covering the face of the recording head, said cap having an ink flow path with an ink suction port on an interior side thereof, and an ink exhaust port communicating with said ink suction port through a continuously curved surface, said ink exhaust port being located on another side opposite to said ink suction port, said ink exhaust port of said ink flow path having a smaller area than that of said ink suction port;

an ink absorbing member provided within said cap, said ink absorbing member covering a part of said ink suction port, and maintaining a remaining part thereof open; and suction mean for exerting a suction force inside of said cap, said suction means communicating with said ink exhaust port.

2. A suction recovery device according to claim 1, wherein said ink absorbing member covers an area including a central portion of said ink suction port, and maintains a remaining area of said ink suction pot open, so that more than about ½ of an area of said ink suction port is covered.

3. A suction recovery device according to claim 1, wherein an opening width of said ink suction port is the same as that of said ink absorbing member within said cap.

4. A suction recovery device according to claim 1, wherein said part of said ink suction port covered by said ink absorbing member is a side face within said cap.

5. A suction recovery device according to claim 1, wherein the recording head is provided with heating elements for generating a heat energy with which the ink is discharged.

6. A suction recovery device according to claim 5, wherein the recording head causes a state change in the ink due to film boiling of the ink, by using the heat energy which the heating elements generate, and discharge the ink owing to a rapid change of the state of the ink.

7. A suction recovery device according to claim 1, in combination with an electronic typewriter with a word processor feature.

8. An ink jet recording apparatus comprising:

a recording head for recording on a recording medium with the discharge of ink thereon, said recording head having a face having a discharge port for discharging ink onto the recording medium;

a cap for covering the face of said recording head, said cap having an ink flow path with an ink suction port on an interior side thereof, and an ink exhaust port communicating with said ink suction port through a continuously curved surface, said ink exhaust port being located on another side opposite to said ink suction port, said ink exhaust port of said ink flow path having a smaller area than that of said ink suction port;

an ink absorbing member provided within said cap, said ink absorbing member covering a part of said ink suction port, and maintaining a remaining part thereof open; and suction means for exerting a suction force inside of said cap, said suction means communicating with said ink exhaust port.

9. An ink jet recording apparatus according to claim 8, wherein said ink absorbing member covers an area including a central portion of said ink suction port, and maintains a remaining area of said ink suction port open, so that more than about ½ of an area of said ink suction port is covered.

10. An ink jet recording apparatus according to claim 8, wherein an opening width of said ink suction port is the same as that of said ink absorbing member with said cap.

11. An ink jet recording apparatus according to claim 8, wherein said part of said ink suction port covered by said ink absorbing member is side face within said cap.

12. An ink jet recording apparatus according to claim 8, wherein said recording head is provided with heating elements for generating a heat energy with which the ink is discharged.

13. An ink jet recording apparatus according to claim 12, wherein said recording head causes a state change in the ink due to film boiling of the ink, by using the heat energy which said heating elements generate, and discharges the ink owing to a rapid change of the state of the ink.

14. An ink jet recording apparatus according to claim 8, wherein said ink jet recording apparatus is an electronic typewriter with a work processor feature.

* * * * *

UNITED STATES PATENT AND TRADEMARK OFFICE

CERTIFICATE OF CORRECTION

PATENT NO. : 5,214,447

DATED : May 25, 1993

INVENTOR(S) : KAZUYA IWATA

It is certified that error appears in the above-identified patent and that said Letters Patent is hereby corrected as shown below:

COLUMN 1

Line 38, "ember" should read --member-- and
"cop" should read --cap--.
Line 39, "he" should read --the--.
Line 40, "int eh" should read --in the--.
Line 52, "4,558,332)" should read --4,558,333)--.

COLUMN 2

Line 4, "certain" should read --a certain--.
Line 10, "a" should read --an--.
Line 13, "port the" should read --port. The--.
Line 15, "camp." should read --cap.--.
Line 24, "a of" should read --a face of--.

COLUMN 5

Line 1, "denotes" should read --is--.
Line 37, "main" should read --the main--.
Line 48, "(thereafter" should read --(hereafter--.
Line 60, "hausing" should read --hausting--.

COLUMN 6

Line 17, "cap" should read --a cap--.
Line 30, "discharge" should read --discharge,--.

COLUMN 7

Line 32, "nating" should read --nated--.

--

UNITED STATES PATENT AND TRADEMARK OFFICE

CERTIFICATE OF CORRECTION

PATENT NO. : 5,214,447

DATED : May 25, 1993

INVENTOR(S) : KAZUYA IWATA

It is certified that error appears in the above-identified patent and that said Letters Patent is hereby corrected as shown below:

COLUMN 10

Line 11, "formed" should read --tray--.
Line 41, "stood" should read --standing--.
Line 50, "lease," should read --lease--.
Line 62, "327" should read --372--.

COLUMN 11

Line 4, "the the" should read --the above-discussed engagement of elements, the--.
Line 5, "described engagement of elements" should be deleted.
Line 29, "right these" should read --right direction in these--.
Line 55, "convey," should read --convey--.

COLUMN 12

Line 9, "resin)." should read --resin.--.
Line 16, "presser," should read --presser--.

COLUMN 13

Line 22, "view" should read --views--.

COLUMN 14

Line 6, "presser," should read --presser--.
Line 24, "B" should read --40B--.
Line 68, "driven" should read --driven,--.

--

UNITED STATES PATENT AND TRADEMARK OFFICE

CERTIFICATE OF CORRECTION

PATENT NO. : 5,214,447

DATED : May 25, 1993

INVENTOR(S) : KAZUYA IWATA

It is certified that error appears in the above-identified patent and that said Letters Patent is hereby corrected as shown below:

COLUMN 15

Line 53, "(thereafter" should read --(hereafter--.

COLUMN 16

Line 12, "a the" should read --the--.
Line 14, "roll" should read --roller--.
Line 31, "the," should read --the--.
Line 61, "290." should read --290A.--.

COLUMN 17

Line 5, "be" should read --the--.
Line 19, "paper 94" should read --paper 96--.
Line 25, "don" should read --on--.
Line 41, "of" should be deleted.
Line 61, "a" should read --an--.
Line 68, "274" should read --294--.

COLUMN 18

Line 8, "once" should read --once recorded,--.
Line 15, "capping," should read --capping--.
Line 25, "vated," should read --vated-- and "depressed" should read --depressed,--.
Line 27, "thereafter)," should read --hereafter),--.
Line 35, "the," should read --the--.
Line 44, "setting," should read --setting--.
Line 54, "or" should read --of--.

--

UNITED STATES PATENT AND TRADEMARK OFFICE

CERTIFICATE OF CORRECTION

PATENT NO. : 5,214,447

DATED : May 25, 1993

INVENTOR(S) : KAZUYA IWATA

It is certified that error appears in the above-identified patent and that said Letters Patent is hereby corrected as shown below:

COLUMN 19

Line 4, "If" should read --It--.
Line 19, "i" should read --in--.
Line 47, "indicated, above" should read --indicated above,--.
Line 48, "storing for" should read --for storing--.
Line 50, "An" should be deleted.

COLUMN 20

Line 35, "3" should read --53--.
Line 55, "area" should read --the area--.
Line 65, "toward," should read --toward--.

COLUMN 21

Line 33, "discharge" should read --discharged--.

COLUMN 22

Line 19, "shon" should read --shown--.

COLUMN 23

Line 24, "11" should read --59--.
Line 28, "55," should read --59,--.

COLUMN 24

Line 25, "4,463,3594" should read --4,463,359--.

--

UNITED STATES PATENT AND TRADEMARK OFFICE

CERTIFICATE OF CORRECTION

PATENT NO. : 5,214,447

DATED : May 25, 1993

INVENTOR(S) : KAZUYA IWATA

It is certified that error appears in the above-identified patent and that said Letters Patent is hereby corrected as shown below:

COLUMN 25

Line 23, "durat-" should read --duration,--
Line 24, "ing duration" should be deleted.
Line 25, "number" should read --number of--.
Line 45, "mean" should read --means--.
Line 51, "pot" should read --port--.

COLUMN 26

Line 9, "charge" should read --charges--.
Line 60, "work" should read --word--.

Signed and Sealed this

Twenty-sixth Day of July, 1994

Bruce Lehman

*Attest:*

BRUCE LEHMAN

*Attesting Officer*

*Commissioner of Patents and Trademarks*

--